US005442424A

United States Patent [19]

Ito

[11] Patent Number: 5,442,424

[45] Date of Patent: Aug. 15, 1995

[54] IMAGE RECORDING DEVICE FOR FORMING AN ELECTROSTATIC LATENT IMAGE ON AN IMAGE HOLDING MEMBER

[75] Inventor: Isao Ito, Ebina, Japan

[73] Assignee: Fuji Xerox Co., Ltd., Tokyo, Japan

[21] Appl. No.: 222,699

[22] Filed: Apr. 4, 1994

[30] Foreign Application Priority Data

Apr. 6, 1993 [JP] Japan ..... 5-079468

[51] Int. Cl.[6] ..... G03G 15/04

[52] U.S. Cl. ..... 355/244; 355/210; 347/120

[58] Field of Search ..... 355/67, 210, 220, 228, 355/244, 277, 317; 346/153.1, 158, 159

[56] References Cited

U.S. PATENT DOCUMENTS

| | | | |
|---|---|---|---|
| 4,398,816 | 8/1983 | Nakajima et al. | 355/244 |
| 4,697,913 | 10/1987 | Kuramoto et al. | 355/244 X |
| 4,819,019 | 4/1989 | Egawa et al. | 355/244 X |

FOREIGN PATENT DOCUMENTS

| | | |
|---|---|---|
| 49-77641 | 7/1974 | Japan . |
| 56-116064 | 9/1981 | Japan . |
| 58-40574 | 3/1983 | Japan . |
| 59-164154 | 9/1984 | Japan . |
| 61-51335 | 3/1986 | Japan . |
| 61-51355 | 3/1986 | Japan . |
| 63-192008 | 8/1988 | Japan . |
| 4-15953 | 3/1992 | Japan . |

*Primary Examiner*—William J. Royer
*Attorney, Agent, or Firm*—Oliff & Berridge

[57] ABSTRACT

An image recording device forming an electrostatic latent image on a surface of an image holding member in accordance with image information and transferring by pressure an image made by developing the electrostatic latent image to a transfer medium which passes through a contact portion between the image holding member and a pressure roller bearing against it is disclosed, including: a plurality of electrostatic latent image forming devices disposed adjacent to and around the circumference of the image holding member at predetermined spacings and forming an electrostatic latent image on the image holding member; and a controlling device for starting the electrostatic latent image formation by an electrostatic latent image forming device disposed upstream around the circumference of the image holding member, stopping electrostatic latent image formation by the electrostatic latent image forming device disposed upstream around the circumference of the image holding member immediately before the transfer medium completes the process of entering the contact portion between the image holding member and the pressure roller, and continuing electrostatic latent image formation by an electrostatic latent image forming device disposed downstream around the circumference of the image holding member, after the transfer medium enters the contact portion between the image holding member and the pressure roller.

10 Claims, 18 Drawing Sheets

IMAGE RECORDING DEVICE FOR FORMING AN ELECTROSTATIC LATENT IMAGE ON AN IMAGE HOLDING MEMBER

FIELD OF THE INVENTION

The present invention relates to an image recording device which transfers (here, transfer may include fixing) a toner image formed on an image holding member to a transfer medium by pressure, and especially to a device wherein image degradation is prevented when the transfer medium enters the contact portion for transferring and fixing.

BACKGROUND OF THE INVENTION

For example, Japanese unexamined patent application number Sho 56-116064 (1981) and Japanese examined patent application number Hei 4-15953 (1992) describe image recording devices of this type. In these devices, a toner image is formed on an image holding member such as a photoreceptive drum or a dielectric drum by predetermined means and the image formed on the image holding member is transferred to the transfer medium supplied to the contact portion between the image holding member and the pressure roller bearing against it, so the image holding member and the pressure roller are contacted under a pressure of 20 to 200 $kg/cm^2$ or 18 to 125 kg/cm.

In the above described image recording devices, as a predetermined pressure is applied between the image holding member and the pressure roller, the contact pressure between them is increased when the transfer medium enters the contact portion by an amount approximately corresponding to the thickness of the transfer medium, so when the transfer medium enters the contact portion, the temporary increase of the load causes a variation of torque in the drive means which rotates the image holding member, which causes a temporary non-uniformity in the rotation of the image holding member. Here, the image formation is being continued on the surface of the image holding member by the image-forming means, and if there is a temporary non-uniformity in the rotation of the image holding member, distortion is caused in the partly recorded image, which in turn causes image defects.

To solve this problem, the use of low pressure toner to reduce the contact pressure between the image holding member and the pressure roller and again to reduce the variation of rotation speed of the image holding member when the transfer medium entering has been tried, and as described in Japanese unexamined patent application number Sho 58-40574 (1983), the provision of a flywheel to the image holding member, which reduces the variation of rotation speed of the image holding member, has also been tried.

The above described conventional image recording device, however, has the following problems, that is, if the contact pressure between the image holding member and the pressure roller is reduced and low pressure toner is used, fusion of toner is caused by stress inside the developing device, and if a flywheel is used, it may be possible to prevent image defects, but the device is inevitably made more bulky and heavier.

SUMMARY OF THE INVENTION

It is an object of the present invention to provide an image recording device free of the defects found in the conventional art.

It is another object of the present invention to provide an image recording device capable of preventing image defects when the transfer medium entering the contact portion between the image holding member and the pressure roller, while avoiding the problems of toner fusion caused by the use of low pressure toner and excessive bulk or weight.

Additional objects and advantages of the invention will be set forth in part in the description which follows and in part will be apparent from the description, or may be learned by practice of the invention.

The image recording device according to the present invention, which forms an electrostatic latent image on the surface of the image holding member in accordance with image information and transfers by pressure the image made by developing the latent image to the transfer medium which passes through the contact portion between the image holding member and the pressure roller bearing against it, comprises: a plurality of electrostatic latent image forming means disposed adjacent to and around the circumference of the image holding member at predetermined spacing and forming an electrostatic latent image on the image holding member; and controlling means for starting electrostatic latent image formation by electrostatic latent image forming means disposed upstream around the circumference of the image holding member, stopping electrostatic latent image formation by the electrostatic latent image forming means disposed upstream around the circumference of the image holding member immediately before the transfer medium completes the process of entering the contact portion between the image holding member and the pressure roller, and continuing electrostatic latent image formation by electrostatic latent image forming means disposed downstream around the circumference of the image holding member after the transfer medium enters the contact portion between the image holding member and the pressure roller.

Of these electrostatic latent image forming means, the one disposed furthest upstream around the circumference of the image holding member acts both as means for forming an electrostatic latent image by controlling ion flow and charging means for charging the surface of the image holding member uniformly.

Further, if necessary, angular position detecting means which detects the angular position of the image holding member is also provided.

The image recording device according to the present invention, which forms an electrostatic latent image on the surface of the image holding member in accordance with image information and transfers the image made by developing the latent image to the transfer medium which passes through the contact portion between the image holding member and the pressure roller bearing against it, may also comprise: electrostatic latent image forming means movable and disposed adjacent to and around the circumference of the image holding member and forming an electrostatic latent image on the image holding member; switching means for switching the position where the electrostatic latent image is formed in the process of electrostatic latent image formation, such that the electrostatic latent image forming means can form an the electrostatic latent image in a plurality of positions around the circumference of the image holding member; and controlling means for starting electrostatic latent image formation by electrostatic latent image forming means disposed upstream around the circumference of the image holding member, stopping electrostatic latent image formation by the electrostatic latent image forming means disposed upstream around the circumference of the image holding member and switching the position where the electrostatic latent image is formed by the electrostatic latent image forming means to the predetermined position downstream around the circumference of the image holding member immediately before the transfer medium completes the process of entering the contact portion between the image holding member and the pressure roller, and continuing electrostatic latent image formation by electrostatic latent image forming means switched to the position downstream around the circumference of the image holding member after the transfer medium enters the contact portion between the image holding member and the pressure roller.

The electrostatic latent image forming means forms an electrostatic latent image by controlling ion flow and comprises switching means which moves the electrostatic latent image forming means around the circumference of the image holding member.

Further, the electrostatic latent image forming means forms an electrostatic latent image by optical exposure and comprises switching means which switches the position where the image is exposed by the electrostatic latent image forming means.

The image recording device according to the present invention starts electrostatic latent image formation by electrostatic latent image forming means disposed upstream around the circumference of the image holding member, stops electrostatic latent image formation by the electrostatic latent image forming means disposed upstream around the circumference of the image holding member immediately before the transfer medium completes the process of entering the contact portion between the image holding member and the pressure roller, and controls the electrostatic latent image formation to be continued by the electrostatic latent image forming means disposed downstream around the circumference of the image holding member after the transfer medium enters the contact portion between the image holding member and the pressure roller.

The image recording device according to the present invention starts electrostatic latent image formation by electrostatic latent image forming means disposed upstream around the circumference of the image holding member, stops electrostatic latent image formation by the electrostatic latent image forming means disposed upstream around the circumference of the image holding member and switches the position where the electrostatic latent image is formed by the electrostatic latent image forming means to a predetermined position downstream around the circumference of the image holding member by the switching means immediately before the transfer medium completes the process of entering the contact portion between the image holding member and the pressure roller, and controls the image formation to be continued by the electrostatic latent image forming means switched downstream around the circumference of the image holding member after the transfer medium enters the contact portion between the image holding member and the pressure roller.

BRIEF DESCRIPTION OF THE DRAWING

The manner by which the above objects and other objects, features and advantages of the present invention are attained will be fully evident from the following detailed description when it is considered in light of the accompanying drawings, wherein;

FIG. 13 (*b*) shows a timing chart for the transfer medium detecting signal.

DETAILED DESCRIPTION OF THE INVENTION

The present invention is now described based on the embodiments shown in the figures.

EMBODIMENT 1

Figure 1:
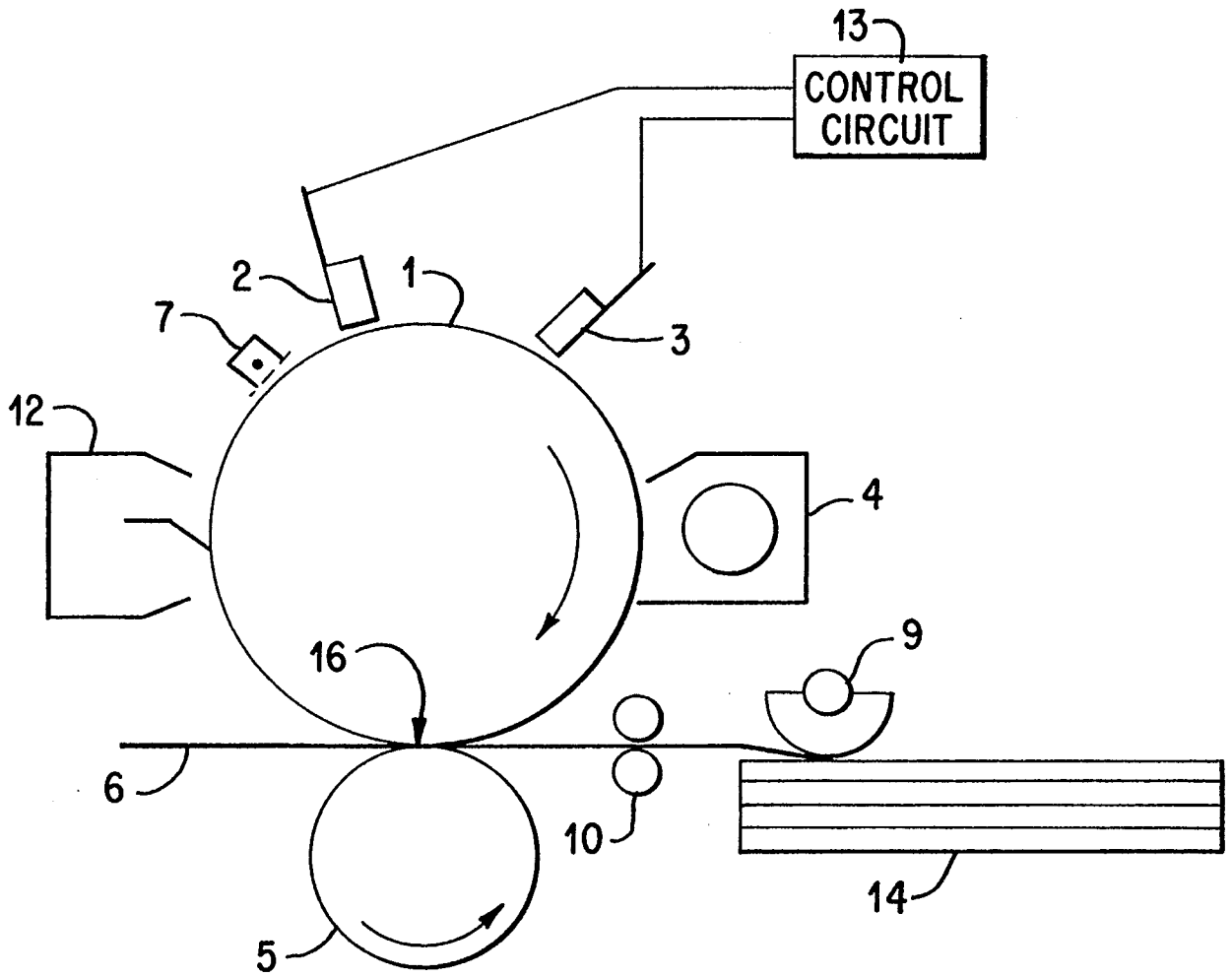
FIG. 1 shows a first embodiment of the image recording device according to the present invention.

FIG. 1 shows a first embodiment of the image recording device according to the present invention.

In FIG. 1, 1 is a dielectric drum used as an image holding member and it is rotated in the direction shown by an arrow by the drive means which is not shown in the figure at a surface speed of 25.4 mm/second. For the dielectric drum 1, for example, an aluminum drum whose surface is anodized and then sealed with epoxy resin may be used. The hardness of the surface of the dielectric drum is, for example, 500 on the Vickers hardness scale.

Two recording heads, 2 and 3, are provided as electrostatic latent image forming means around the circumference of the dielectric drum 1 at a predetermined spacing therebetween, being adjacent to the surface of the dielectric drum 1. The distance between them is, for example, 25.4 mm on the dielectric drum 1. The distance is at least a value obtained by multiplying the time from when the leading (or trailing) edge of the transfer medium 6 enters (or leaves) the contact portion for transferring and fixing 16 until the rotation is stabilized plus a time margin, which is for example 0.8 seconds, by the process speed of 25.4 mm/second. An electrostatic latent image is formed on the surface of the dielectric drum 1 in accordance with image information by appropriately controlling the two recording heads 2 and 3. For the recording heads 2 and 3, may be used the one described in Japanese unexamined patent application number Sho 61-51355 (1986).

Figure 2:
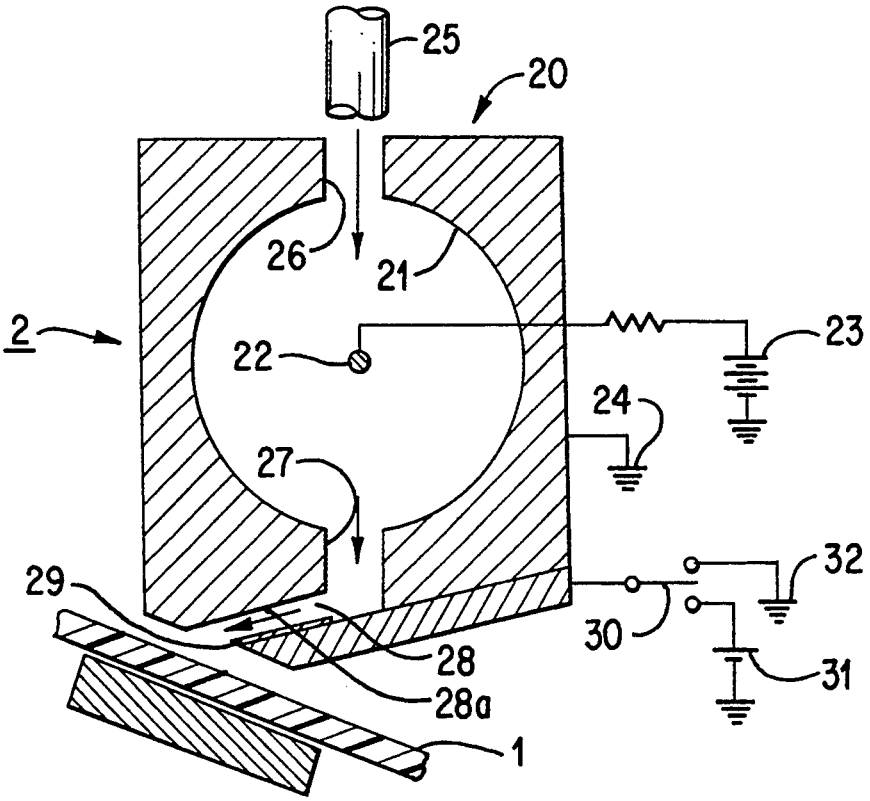
FIG. 2 shows the structure of a recording head.

Each of the recording heads 2 and 3 comprises, as shown in FIG. 2, a conductive corona chamber 21 included in a housing 20, a corona wire 22 supported inside the conductive corona chamber 21 such that it extends in the direction perpendicular to the transfer medium, a high voltage power supply 23 to apply a high voltage of some thousands of volts to the corona wire 22 and a standard potential source 24 connected to the external wall of the conductive corona chamber 21. By applying a high voltage from the high voltage power supply 23 to the corona wire 22, corona discharge occurs, which produces ions of a predetermined, preferably positive, polarity. Thus produced ions are attracted to the wall of the conductive corona chamber 21 and the chamber is filled with charged ions.

A compressed transport fluid (preferably air), which is used for transporting many ions filling the conductive corona chamber 21 as an ion flow, is fed inside the conductive corona chamber 21 from a supply tube 25 through the inlet channel 26 extending in the direction shown by the arrow. The ion flow is output from the conductive corona chamber 21 through the outlet channel 27 provided in the direction shown by the arrow and again through the ion-modulating region 28.

When output from the conductive corona chamber 21 by the transport fluid through the outlet channel 27, the ion flow is controlled in accordance with the printing information in the ion-modulating region 28. The control is realized by selectively applying a low potential of the order of 10 to 30 volts (DC) and supplied from a low voltage source 31 and a standard potential 32 to the ion-controlling electrodes 29 provided in large number in an array on the ion-modulating region 28 by means of a thin film transistor 30.

As the ion-controlling electrodes 29 and the grounded wall 28*a* facing the electrodes 29 across the spacing of the ion-modulating region 28 form a capacitor, if the ion-controlling electrodes 29 corresponding to the image information are connected to the low voltage source 31 by the thin film transistor 30, a low voltage is applied between the ion-controlling electrodes 29 and the facing wall 28*a*, by which an electric field is selectively caused in the direction perpendicular to the flow of the transport fluid, and the ion flow is deflected. The ions in the flow are changed from ions into uncharged air molecules by colliding against the grounded wall 28*a* and is emitted in the air. On the other hand, if the ion-controlling electrodes 29 are connected to the standard potential source 32 by the thin film transistor 30, the ion flow passes along the path between the ion-controlling electrodes 29 and the facing wall 28*a*, free of the influence from the electric field.

The ion flow output from the housing 20 through the outlet channel 27 is attracted to the dielectric drum 1, and the ion flow is received and charges the dielectric drum 1, thus forming a charged latent image.

For the recording heads 2 and 3, may be used the one described in Japanese unexamined patent application number Sho 59-164154 (1984) or any known others, in addition to the one described in Japanese unexamined patent application number Sho 61-51355 (1986).

Figure 3:
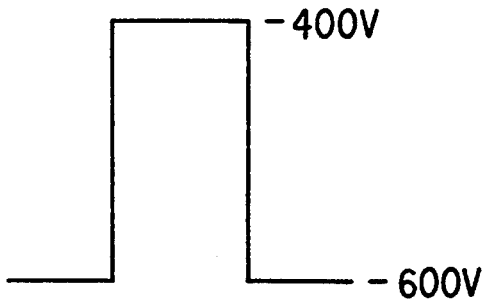
FIG. 3 shows the potentials of the electrostatic latent image.

In the present embodiment, the surface of the dielectric drum 1 is charged to −600 V uniformly in advance by a scorotron 7, such that the ion flow of positive polarity output from the recording heads 2 and 3 is converged. As a result, an electrostatic contrast having an image density of 300 dpi as shown in FIG. 3 can be recorded on the dielectric drum 1.

Further, as shown in FIG. 1, a developing device 4 to develop the electrostatic latent image formed on the dielectric drum 1 is disposed downstream of the recording head 3, being adjacent to the surface of the dielectric drum 1. For the developing device 4, may be used any appropriately selected known developing device. In the present embodiment, for the developing device 4, the one employing a conductive magnetic single-component developing system is used and the portion whose potential is −400 V with respect to the developing bias of −600 V is developed.

The toner image formed on the dielectric drum 1 by the developing device 4 is transferred and fixed on the transfer medium 6 by the pressure roller 5 contacting the dielectric drum 1 under a predetermined pressure, and the transfer medium 6 with the toner image transferred and fixed thereon is output, by which the image recording process is completed.

After that, debris on the surface of the dielectric drum 1 such as remaining toner is removed by the cleaner 12 which is in the form of a blade and the device is made to be ready for the next image recording process.

The transfer medium 6 is fed from the transfer medium holder 14 by the transfer medium feeding roller 9, and then it is supplied to the contact portion for transferring and fixing 16 by the transfer medium feeding roller 10 in synchronism with the timing corresponding to the entrance of the leading edge of the transfer medium.

Figure 4:
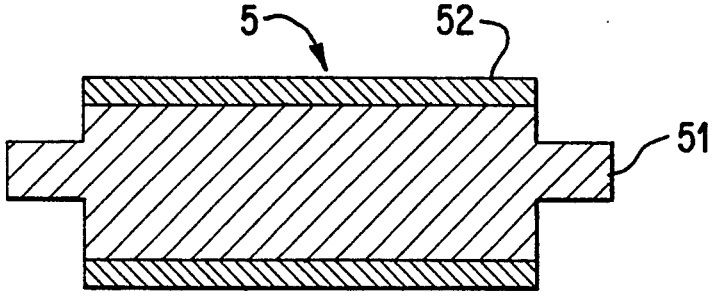
FIG. 4 is a cross-sectional view of the pressure roller.

FIG. 4 shows the cross-sectional structure of the pressure roller.

The pressure roller 5, as shown in FIG. 4, comprises a steel shaft 51 and a urethane resin 52 coating the shaft 51. The pressure roller 5 and the dielectric drum 1 are contacted by load applying means which is not shown in the figure under a linear pressure of 20 kg/cm with a skew angle of 0.5°.

For the pressure roller 5, may be used a support roller supported only by the center portion as shown in Japanese unexamined patent application number Sho 49-77641 (1974). In this case, as the pressure uniformity is good compared with a solid roller, the skew angle may be 0°.

Figure 5:
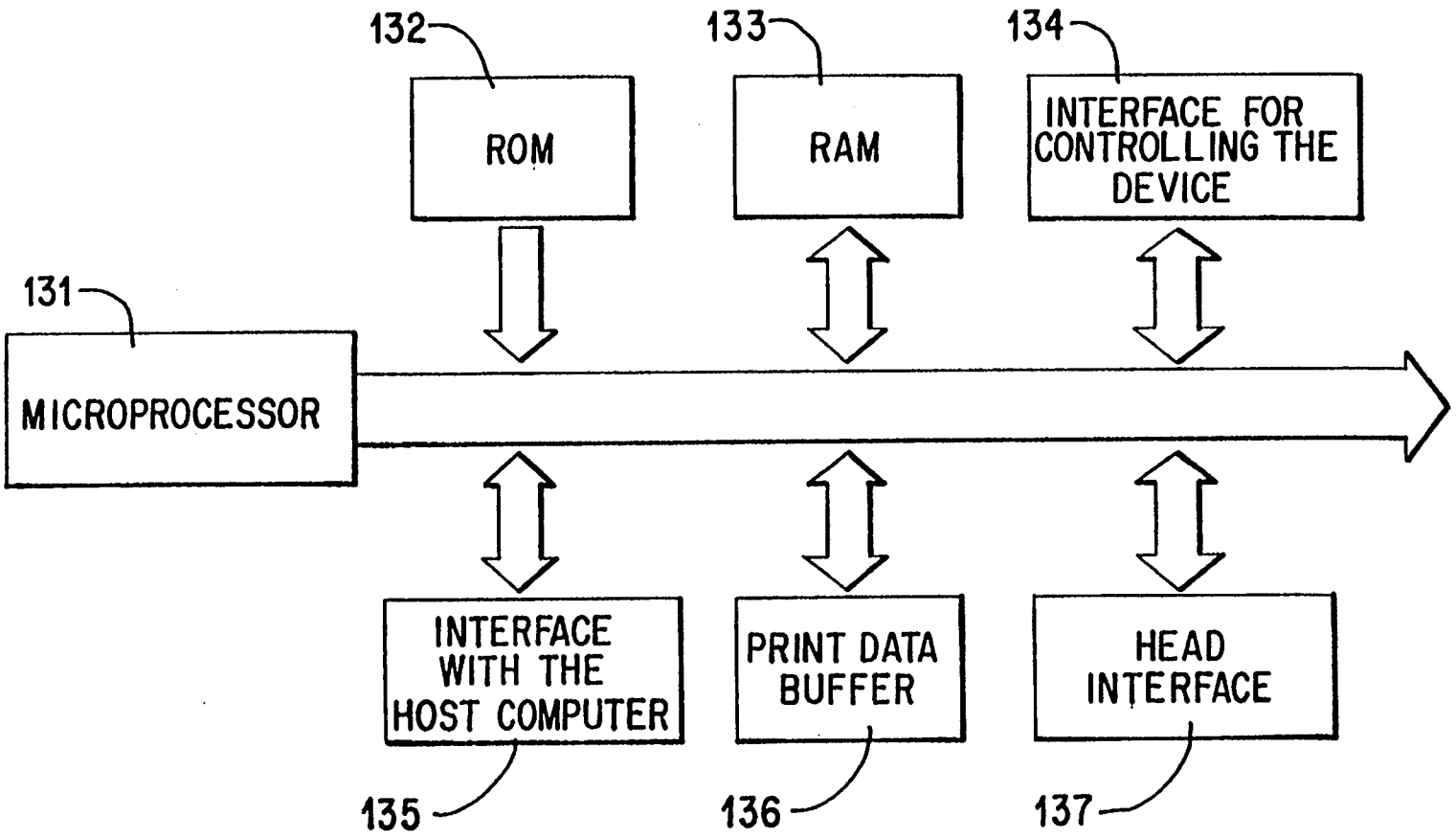
FIG. 5 shows a block diagram of the control circuit.
Figure 6A:
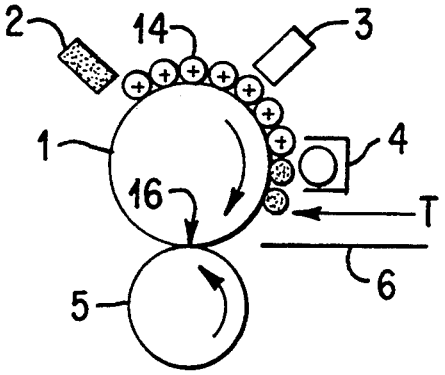
FIGS. 6 (*a*) to (*f*) show the behavior of the image recording device.
Figure 6B:
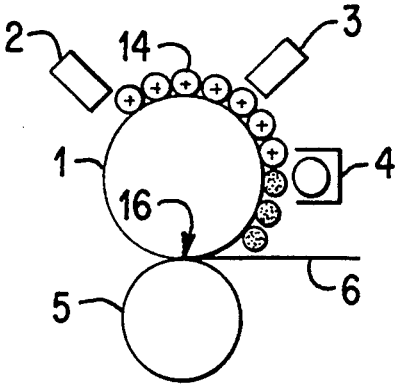
Figure 6C:
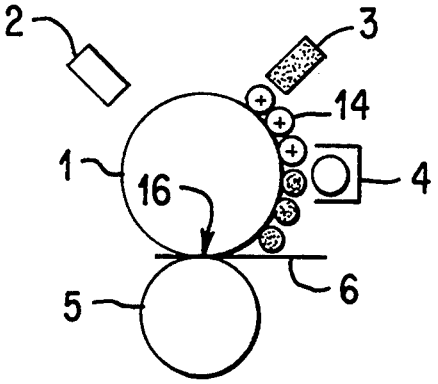
Figure 6D:
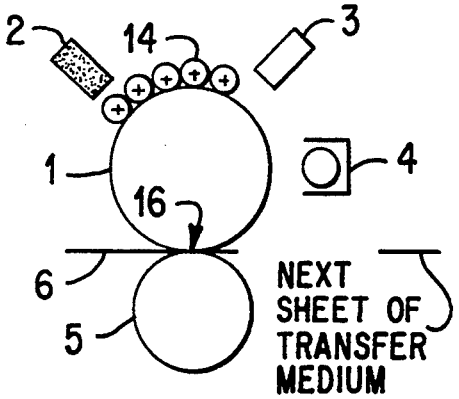
Figure 6E:
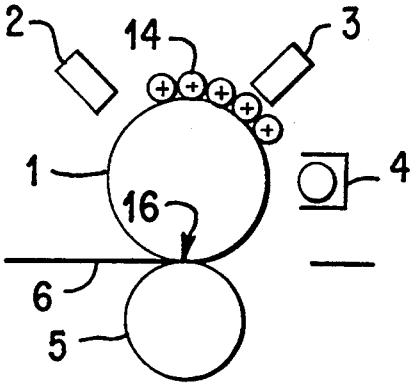
Figure 6F:
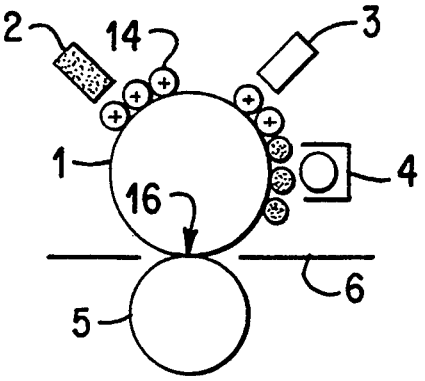

FIG. 5 is a block diagram showing the control circuit 13 of the image recording device according to the present embodiment.

In the figure, 131 is a microprocessor, which functions to control the whole image recording device. The control circuit comprises the microprocessor 131, a ROM 132 to store the program of the microprocessor 131, a RAM 133 which is a temporary data storing portion, an interface 134 for controlling the device, an interface 135 with the host computer, a print data buffer 136 to store the print data transmitted from the host computer temporarily and an interface 137 with the recording heads 2 and 3.

In the present embodiment, image recording is controlled by the microprocessor 131 and the microprocessor 131 first starts recording an electrostatic latent image on the dielectric drum 1 by the recording head 2, and once stops the electrostatic latent image recording immediately before the transfer medium 6 completes the process of entering the contact portion for transferring and fixing 16 between the dielectric drum 1 and the pressure roller 5. After the transfer medium 6 passes through the contact portion 16, the electrostatic latent image recording is restarted by the recording head 3, such that the partly recorded image joins onto the portion to be recorded.

With the above described structure, in the image recording device according to the present embodiment, image defects occurring when the transfer medium entering the contact portion for transferring and fixing is prevented as follows. As shown in FIG. 5, receiving the print requesting signal from the host computer through the interface 135 with the host computer, the microprocessor 131 starts the drive means of the dielectric drum 1, which is not shown in the figure, through the interface 134 for controlling the device and rotates the dielectric drum 1 at a predetermined rotation speed. When the rotation speed of the dielectric drum 1 reaches a predetermined value, the microprocessor 131 transmits a signal indicating that the print data can be accepted to the host computer through the interface 135 with the host computer. Receiving the signal, the host computer transmits the print data to the image recording device. The microprocessor 131 receives the print data through the interface 135 with the host computer and it transmits the data to the recording head 2 through the interface 137 with the recording head.

As print data is received, the microprocessor 131 starts the transfer medium feeding roller 9 through the interface 134 for controlling the device, by which feeding of the transfer medium 6 is started. The transfer medium 6 is fed to the transfer medium feeding roller 10 by the transfer medium feeding roller 9 and is supplied to the contact portion for transferring and fixing 16 by the transfer medium feeding roller 10.

As shown in FIG. 6 (*a*), an electrostatic latent image 14 corresponding to the print data is formed on the dielectric drum 1 by the recording head 2, and it is developed by the developing device 4 and thus a toner image is formed. The recording heads colored black in FIG. 6 are recording.

As shown in FIG. 6 (*b*), the microprocessor 131 starts to count time from when the feeding of the transfer medium 6 is started, and it stops the transmission of print data to the recording head. 2 when the leading edge of the transfer medium 6 approaches near the contact portion for transferring and fixing 16. Meanwhile, the microprocessor 131 transmits a signal requesting a temporary halt to the print data transmission to the host computer through the interface 135 with the host computer. Here, as there is inevitably a time lag between the timing when the signal requesting a temporary halt to the print data transmission is output from the image recording device to the host computer and the timing when the host computer actually stops the print data transmission to the image recording device, the print data transmitted from the host computer by the lag is temporarily stored in the print data buffer 136.

After that, the transfer medium 6 entering the contact portion for transferring and fixing 16 between the dielectric drum 1 and the pressure roller 5, the microprocessor 131 counts time until the rotation of the dielectric drum 1 is stabilized and then starts transmitting the print data stored in the print data buffer 136 to the recording head 3 through the interface 137 with the recording head. In addition to this, the microprocessor 131 transmits a print data transmission starting signal to the host computer through the interface 135 with the host computer. Receiving the print data transmission starting signal, the host computer restarts the print data transmission, and the microprocessor 131 transmits the transmitted print data to the recording head 3 again and continues printing as shown in FIG. 6 (*c*). Then the timing with which the recording head 3 starts forming an electrostatic latent image is controlled so that the trailing edge of the electrostatic latent image partly formed on the dielectric drum 1 precisely joins onto the portion to be recorded. The electrostatic latent image formed on the dielectric drum 1 is developed by the developing device 4 and becomes the toner image T, and the toner image T is transferred and fixed on the transfer medium 6 passing through the contact portion for transferring and fixing 16. Thus, printing of an image to the first sheet of transfer medium 6 is carried out.

To carry out image printing on a plurality of sheets of recording medium as shown in FIGS. 6(*a*)-(*f*), the image recording device behaves as follows. Receiving the print data for the second sheet of transfer medium, the microprocessor 131 transmits it to the recording head 2 through the interface 137 with the recording head. Meanwhile, as shown in FIG. 6 (*d*), the trailing edge of the first sheet of transfer medium 6 is partway passing the contact portion for transferring and fixing 16, it is necessary for the microprocessor 131 to know the output timing of the transfer medium 6 detected by the timing data counted inside the microprocessor 131. Therefore, as shown in FIG. 6 (*e*), the microprocessor 131 stops transmitting the print data to the recording head 2 immediately before the trailing edge of the first sheet of transfer medium 6 is output from the contact portion for transferring and fixing 16. In this case, however, the microprocessor 131 continues receiving the print data from the host computer without requesting the host computer a temporary halt to print data transmission. The print data continuing to be received is stored in the print data buffer 136, and the print data stored in the print data buffer 136 is transmitted to the recording head 2 at the timing with which the trailing edge of the transfer medium 6 passes through the contact portion for transferring and fixing 16 as shown in FIG. 6 (*f*).

In the present embodiment, the time for which printing is stopped is the same as that produced from the time when the transfer medium enters the contact portion until rotation of the dielectric drum 1 is stabilized plus a time margin, that is 0.8 seconds. When the leading edge of the portion of the recording medium, on which the electrostatic latet image is to be formed comes immediately below the recording head 3, the microprocessor 131 transmits the print data stored in the print data buffer 136 to the recording head 3, by which the rest of the electrostatic latent image which has not been formed while the trailing edge of the transfer medium 6 passes through the contact portion for transferring and fixing 16 is formed on the dielectric drum 1. Here, the next sheet of transfer medium 6 does not enter the contact portion 16 until the formation of the electrostatic latent image is finished by the recording head 3, since the print degradation cannot be prevented while the recording head 3 is operating. Therefore, the image recording device is structured so that the next sheet of transfer medium 6 enters the contact portion 16 after the printing by the recording head 3 is finished.

Figure 7A:
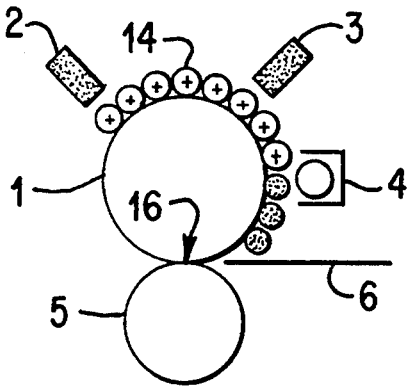
FIGS. 7 (*a*) to (*c*) show the behavior of the image recording device.
Figure 7B:
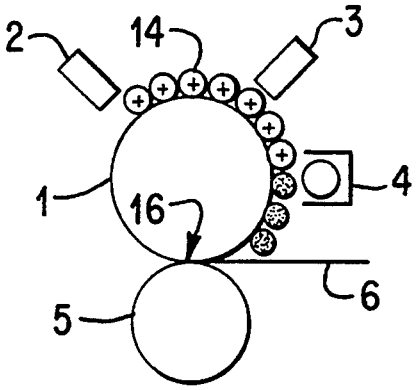
Figure 7C:
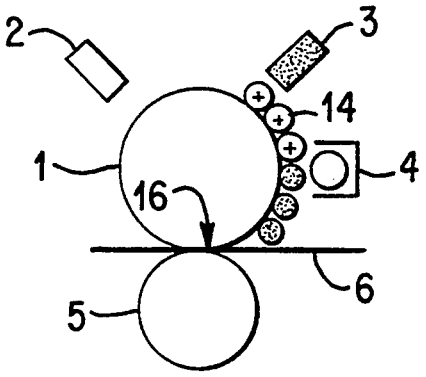

After thus transmitting the print data stored in the print data buffer 136 to the recording head 2 as shown in FIG. 6 (*f*), printing is continued by the recording head 2 until the leading edge of the second sheet of transfer medium 6 enters the contact portion for transferring and fixing 16, and the print data stored while printing is stopped as shown in FIG. 6 (*e*) is recorded by the recording head 3 as shown in FIG. 7 (*a*).

After that, printing by the recording heads 2 and 3 is stopped immediately before the leading edge of the second sheet of transfer medium 6 completes the process of entering the contact portion for transferring and fixing 16 as shown in FIG. 7 (*b*), and the rest of the print data is recorded by the recording head 3 after the leading edge of the transfer medium 6 enters the contact portion for transferring and fixing 16 as shown in FIG. 7 (*c*).

Thus, image printing on a plurality of sheets of transfer medium 6 is carried out.

The microprocessor 131 controls the image recording device such that it starts an electrostatic latent image formation by the recording head 2 disposed upstream in the direction around the circumference of the dielectric drum 1, stops the electrostatic latent image formation by the recording head 2 immediately before the transfer medium 6 completes the process of entering the contact portion for transferring and fixing 16 and it continues the electrostatic latent image formation by the recording head 3 disposed downstream in the direction around the circumference of the dielectric drum 1 after the transfer medium 6 passes through the contact portion between the dielectric drum 1 and the pressure roller 5. As the image recording device is structured so that the electrostatic latent image formation is not carried out when the transfer medium enters the contact portion for transferring and fixing 16, image defects can be prevented.

In the present embodiment, the recording head is not restricted to an ion flow controlling recording head, and if a photoreceptive drum, for example, one using α-silicon as a photoreceptor is used instead of the dielectric drum, an LED image bar, a semiconductor laser, a gas laser or other means may be used for light writing means.

EMBODIMENT 2

FIGS. 8 to 11 inclusive show a second embodiment of the present invention, and portions which are the same as in the first embodiment are identified by the same reference numerals. Here, a photoreceptive drum is used for the image holding member and an LED image bar is used for the recording head 17.

Figure 8:
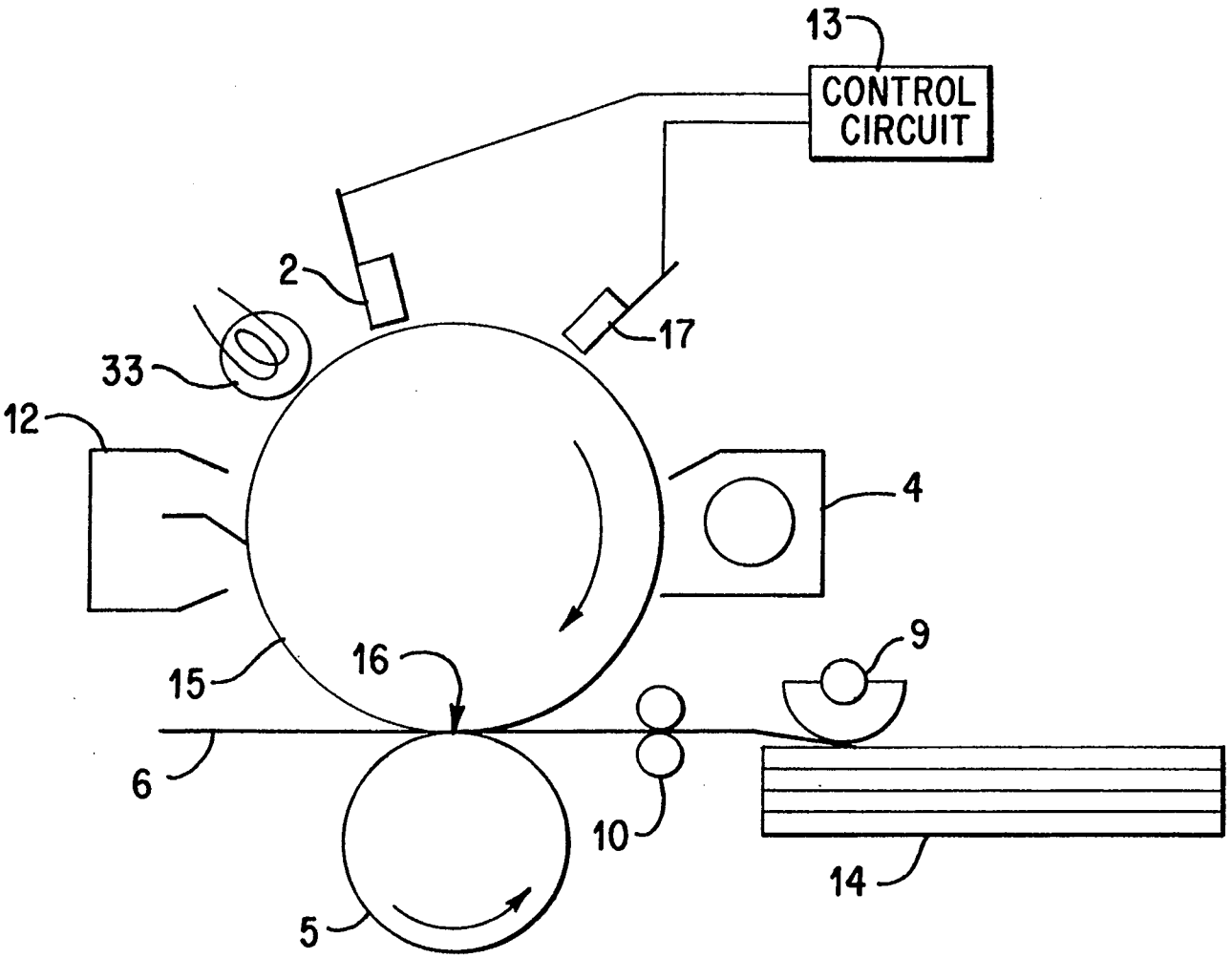
FIG. 8 shows a second embodiment of the image recording device according to the present invention.
Figure 10A:
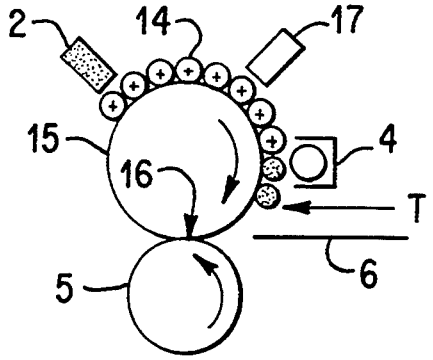
FIGS. 10 (*a*) to (*f*) show the behavior of the image recording device.
Figure 10B:
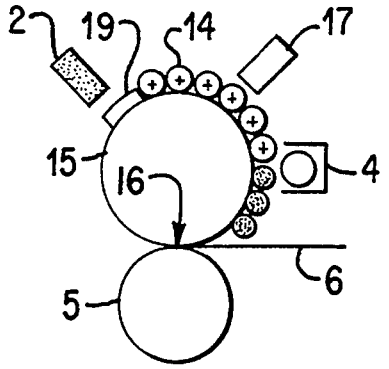
Figure 10C:
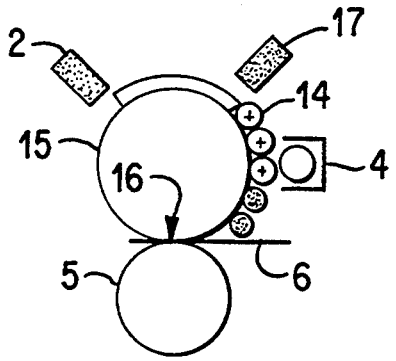
Figure 10D:
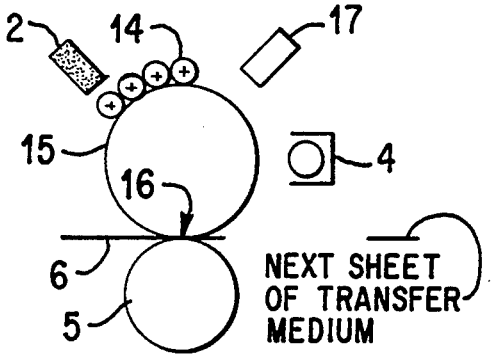
Figure 10E:
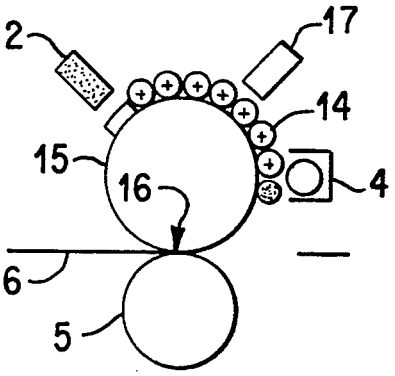
Figure 10F:
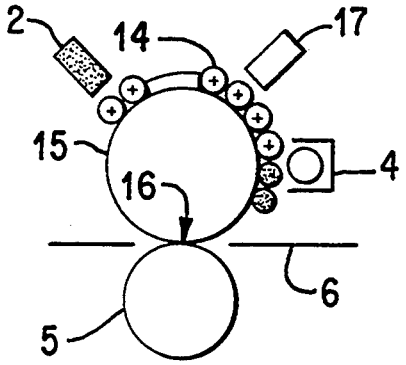

In the present embodiment, as shown in FIG. 8, a photoreceptive drum 15 using α-silicon as a photoreceptor is used as the image holding member. For the LED image bar used as the recording head 17, may be used one which emits by pixel in accordance with the image information, forms an electrostatic latent image and has an image density of, for example 300 dpi. Further, a discharge lamp 33 to remove the remaining charge is disposed downstream of the cleaner 12 and adjacent to the surface of the photoreceptive drum 15.

In the image recording device having such a structure, the recording head 2 is controlled as follows.

Figure 9:
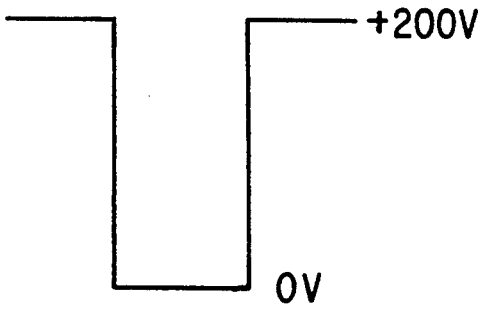
FIG. 9 shows the potentials of the electrostatic latent image.

After the charge is reduced to 0 V by the discharge lamp 16, an electrostatic latent image having the electrostatic contrast as shown in FIG. 9 and an image density of 300 dpi is formed on the surface of the photoreceptive drum 15 by the recording head 2. Here, as the surface potential of the photoreceptive drum 15 is 0 V, a bias voltage of 600 V is applied to the recording head 2 by means which is not shown in the figure in order to form an electric field to converge the ions of positive polarity from the recording head 2, and the recording head 2 forms an electrostatic latent image on the surface of the photoreceptive drum 15 by background writing. The thus formed electrostatic latent image corresponds to the potentials shown in FIG. 9. Further, the recording head 2 also functions as a charging device to charge the surface of the photoreceptive drum 15 to a voltage of +200 V uniformly while it is not forming an electrostatic latent image corresponding to the print data. The developing bias of the developing device 4 is set to be +200 V, and the portion having a voltage of 0 V is developed.

The basic behavior of the image recording device according to the present embodiment is the same as that of the first embodiment, but as the recording head 2 must function as a charging device here, it continues to operate as a charging device while it is not forming an electrostatic latent image as shown in FIG. 10(*a*)–(*f*), and this is the only different point between these image recording devices of the two embodiments. Therefore, compared with the image recording device of the first embodiment, that of the present embodiment has the merit of the omission of a charging device. In FIG. 10(*a*)–(*f*) the recording heads colored black are recording and the ones colored gray are in operation as a charging device.

The behavior of the image recording device according to the present invention is as follows. In this device, as shown in FIG. 10 (*a*), an electrostatic latent image is formed on the photoreceptive drum 15 in accordance with the image information by the recording head 2, and the electrostatic latent image is developed by the developing device 4 and becomes a toner image. On the other hand, the transfer medium 6 to which the toner image is transferred is fed in synchronism with the electrostatic latent image formation. The electrostatic latent image formation by the recording head 2, however, is stopped immediately before the transfer medium 6 completes the process of entering the contact portion for transferring and fixing 16 and then the recording head 2 functions as a charging device, and a uniformly charged portion 19 is formed on the surface of the photoreceptive drum 15 as shown in FIG. 10 (*b*).

When the trailing edge of the electrostatic latent image formed by the recording head 2 reaches the position of the recording head 17 after the transfer medium 6 enters the contact portion for transferring and fixing 16, the electrostatic latent image formation is restarted by the recording head 17, and the electrostatic latent image formation performed in accordance with the image information for the first sheet of transfer medium is completed by the recording head 17. The electrostatic latent image formed on the photoreceptive drum 15 is developed by the developing device 4 and becomes a toner image, and it is transferred and fixed on the transfer medium 6 passing through the contact portion for transferring and fixing 16 as shown in FIG. 10 (*c*).

After that, an electrostatic latent image formation corresponding to the next sheet of transfer medium 6 is started on the photoreceptive drum 15 by the recording head 2 as shown in FIG. 10 (*d*), and the electrostatic latent image formation by the recording head 2 is stopped immediately before the first sheet of transfer medium 6 is output from the contact portion for transferring and fixing 16, and the recording head 2 functions as a charging device and forms a uniformly charged portion 19 on the surface of the photoreceptive drum 15 as shown in FIG. 10 (*e*).

Figure 11A:
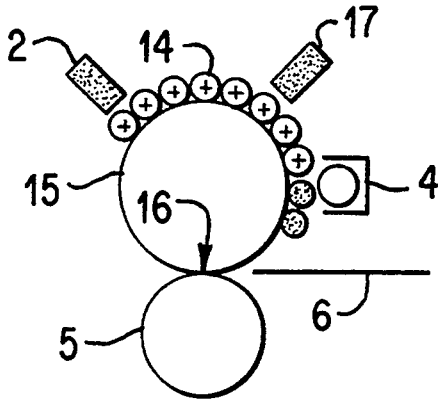
FIGS. 11 (*a*) to (*c*) show the behavior of the image recording device.
Figure 11B:
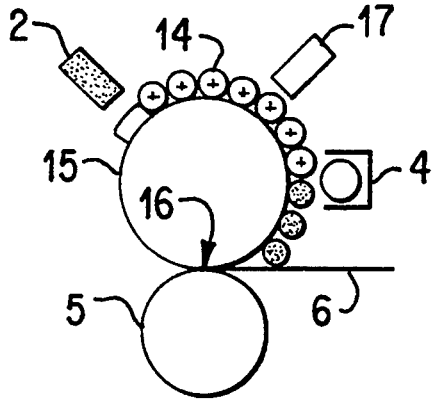
Figure 11C:
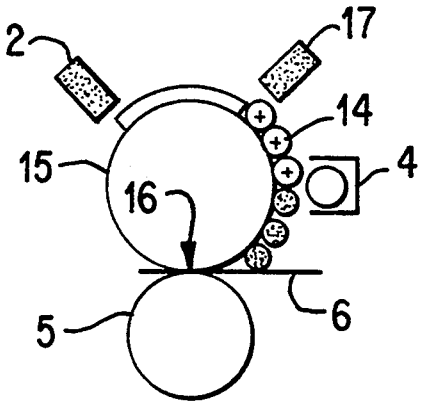

Further, the recording head 2 restarts the electrostatic latent image formation after the transfer medium 6 is output from the contact portion for transferring and fixing 16 as shown in FIG. 10 (*f*), and the recording head 17 continues the partly recorded image formation when the trailing edge of the electrostatic latent image formed by the recording head 2 reaches the position of the recording head 17 as shown in FIG. 11 (*a*). The electrostatic latent image formation by the recording head 2 is stopped immediately before the second sheet of transfer medium 6 completes the process of entering the contact portion for transferring and fixing 16 and the recording head 2 functions as a charging device. Then a uniformly charged portion 19 is formed on the surface of the photoreceptive drum 13 as shown in FIG. 11 (*b*).

When the trailing edge of the electrostatic latent image formed by the recording head 2 reaches the position of the recording head 17 after the transfer medium 6 enters the contact portion for transferring and fixing 16, the electrostatic latent image formation is restarted by the recording head 17, and the electrostatic latent image formation corresponding to the image information for the second sheet of transfer medium is completed by the recording head 17. The electrostatic latent image formed on the photoreceptive drum 15 is developed by the developing device 4, becomes a toner image, and it is transferred and fixed to the transfer medium 6 passing through the contact portion for transferring and fixing 16 as shown in FIG. 11 (*c*).

In the present embodiment, the surface of the photoreceptive drum 15 is uniformly charged by the recording head 2 when the transfer medium 6 enters the contact portion for transferring and fixing 16, and as the non-uniformity of charging caused by the variation of rotation speed when the transfer medium 6 enters the contact portion 16 is not as significant as to be developed, there is no problem in recorded image.

The structure and function of the other portions of the present embodiment are the same as those of the first embodiment, so the description thereof is omitted.

EMBODIMENT 3

Figure 12:
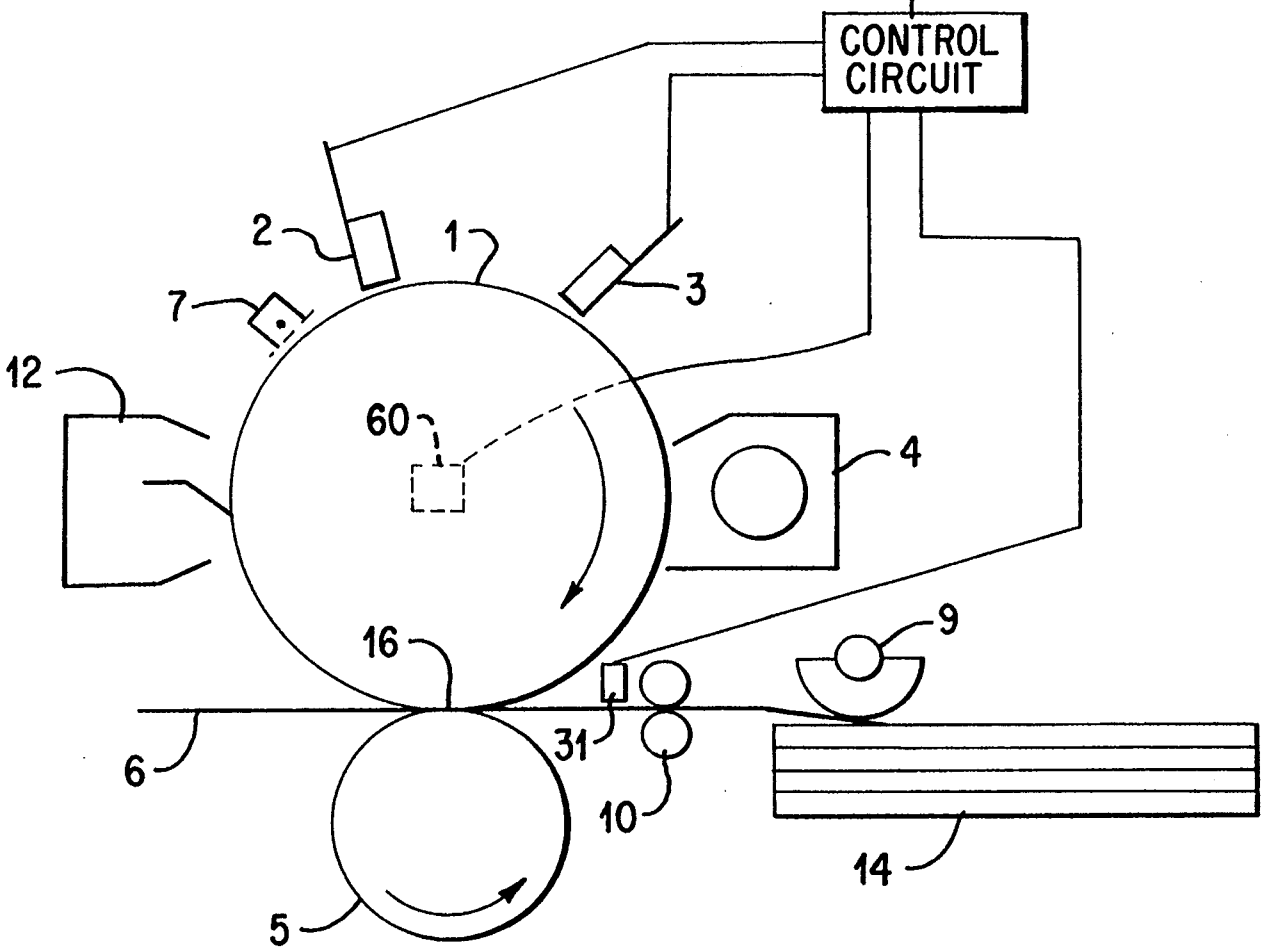
FIG. 12 shows a third embodiment of the image recording device according to the present invention.
Figure 13A:
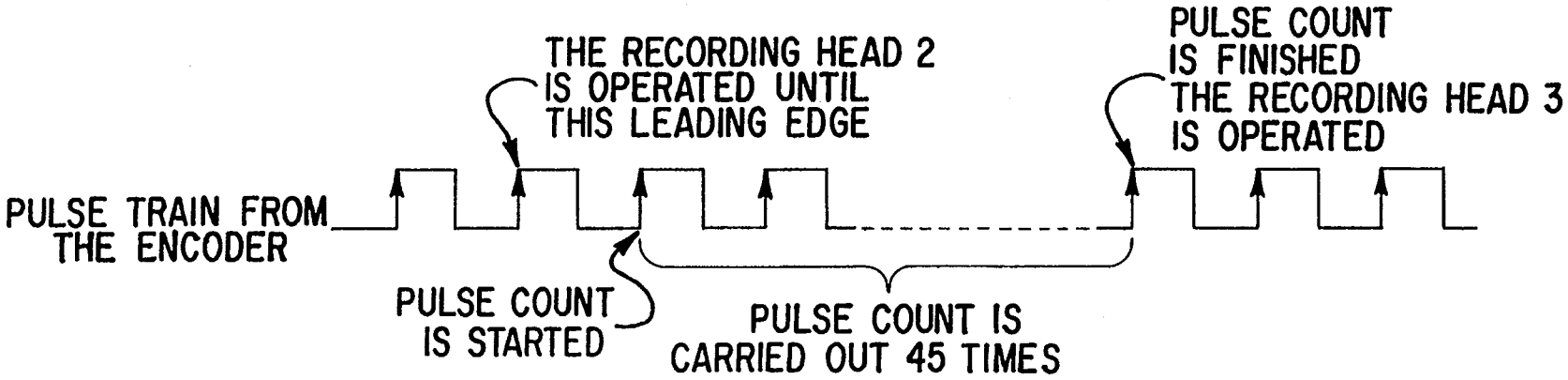
FIG. 13 (*a*) shows a timing chart for the pulse train from the encoder.
Figure 13B:
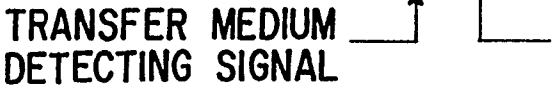

FIGS. 12 and 13 show a third embodiment of the present invention, and the portions which are the same as in the above described embodiments are identified by the same reference numerals. In the present embodiment, the image recording device is structured to comprise a rotary encoder to detect the angular position of the image holding member.

A rotary encoder 60 to detect the angular position of the dielectric drum 1 and which is not shown in the figure is fixed to the rotation axis of the dielectric drum 1. For the rotary encoder, for example, one which generates 360 pulses per single rotation is used, and the pulse output from the rotary encoder are input to the control circuit 13. Reference numeral 31 is a transfer medium detecting sensor and it detects the presence of the transfer medium 6 approaching the contact portion for transferring and fixing 16. The output from the transfer medium detecting sensor 31 is also input to the control circuit 13. In the present embodiment, the two recording heads 2 and 3 which form an electrostatic latent image by ion flow are disposed at a spacing corresponding to an angle of 45° therebetween.

The image recording device according to the present invention behaves as follows. The transfer medium 6 is fed by the transfer medium feeding rollers 9 and 10 according to the print request from the host computer. If the transfer medium detecting sensor 31 detects the leading edge of the transfer medium 6, the detecting signal is passed to the control circuit 13, and the signal is input to the microprocessor 131 through the interface 134 for controlling the device which is shown in FIG. 5. Meanwhile, a pulse train from the rotary encoder which is not shown in the figure is input to the microprocessor 131 through the same interface 134 for controlling the device. As these two signals do not occur simultaneously, the following control is carried out by the microprocessor 131.

If the detecting signal from the transfer medium detecting sensor 31 is input in positive logic as shown in FIG. 13, the microprocessor 131 drives the recording head 2 from when the image recording device is started until when the leading edge of the pulse train output from the rotary encoder, which comes immediately after the leading edge of the detecting signal output from the transfer medium detecting sensor 31 arrives, and the microprocessor 131 starts to count pulses from when the leading edge of the next pulse train arrives. In the present embodiment, the angle between the recording heads 2 and 3 is 45°, and as the rotary encoder outputs one pulse per 1°, the count is carried out 45 times. If the count for 45 pulses is finished, the recording head 3 is started as shown in FIG. 12. With such a structure, compared to the first embodiment, positioning of the electrostatic latent image formed by the recording heads 2 and 3 can be carried out precisely.

The structure and function of the other portions of the present invention are the same as those of the first embodiment, so the description thereof is omitted.

EMBODIMENT 4

Figure 14:
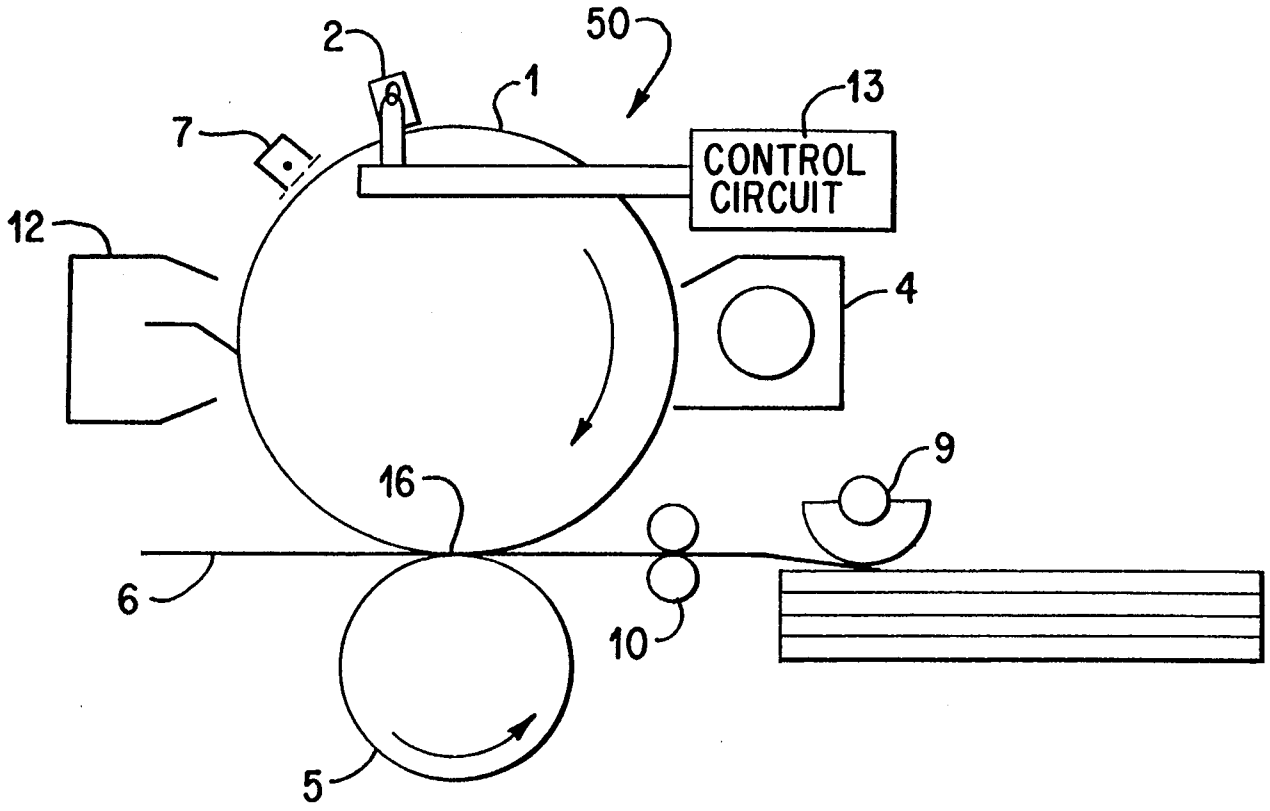
FIG. 14 shows the structure of a fourth embodiment of the image recording device according to the present invention.
Figure 15:
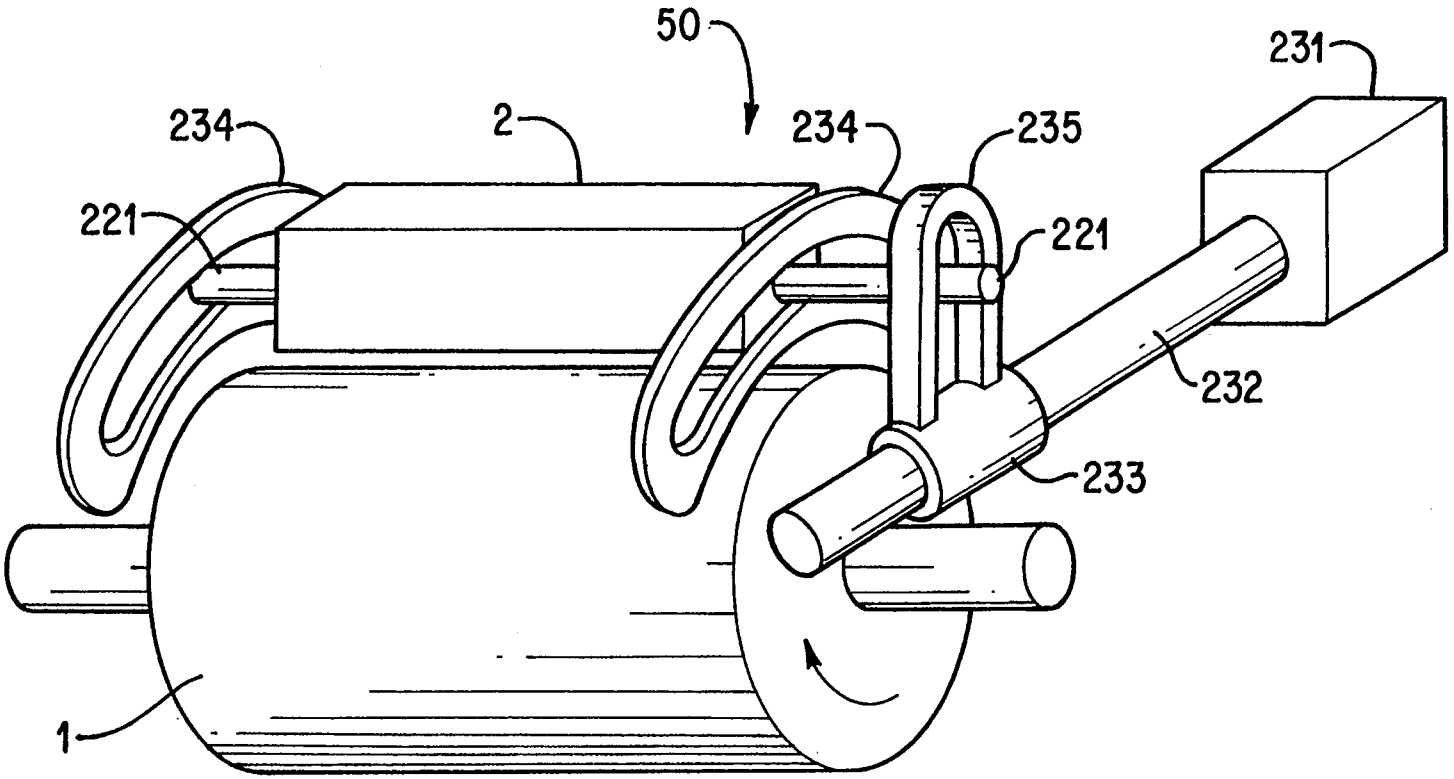
FIG. 15 is a schematic view showing the moving means of the recording head.

FIGS. 14 and 15 show a fourth embodiment of the present invention, and portions which are the same as in the above described embodiment are identified by the same reference numerals. In the present embodiment, only one electrostatic latent image forming means is provided and it is movable to the predetermined position in the direction around the circumference of the image holding member with a predetermined timing.

In the present embodiment, as shown in FIG. 14, only the recording head 2 used as electrostatic latent image forming means is provided adjacent to the dielectric drum 1. For the recording head 2, for example, the one described in Japanese unexamined patent application number Sho 61-51335 (1986) is used.

In the present embodiment, the recording head 2 used as electrostatic latent image forming means is disposed movable to a predetermined position in the direction around the circumference of the dielectric drum 1.

FIG. 15 shows moving means for moving the recording head.

The moving means 50 comprises, as shown in FIG. 15, a drive motor 231, a male screw 232 directly connected to the drive axis of the drive motor 231, a female screw 233 to move on the male screw 232 in accordance with the rotation of the male screw 232, a horseshoe-shaped member 235 fixed to the female screw 233 and supporting the head pin 221 both end portions of which are exposed at both end portions of the axis of the recording head 2 and control members 234 to guide the head pin 221 both end portions of which are exposed at both end portions of the axis of the recording head 2, such that the recording head 2 is moved facing the surface of the dielectric drum 1 with a predetermined spacing therebetween. By rotating the drive motor 231 through a predetermined angle with a predetermined timing, the moving means 50 rotates the male screw 232 directly connected to the drive axis of the drive motor 231, by which the female screw 233 fixed to the male screw 232 is moved in the direction along the axis of the male screw 232. Thus, in the moving means 50, the recording head 2 is movable by a predetermined amount in the direction around, the circumference of the dielectric drum 1, facing the surface of the dielectric drum 1 with a predetermined spacing therebetween by means of the horseshoe-shaped member 235 fixed to the female screw 233 and the head pin 221.

Figure 16:
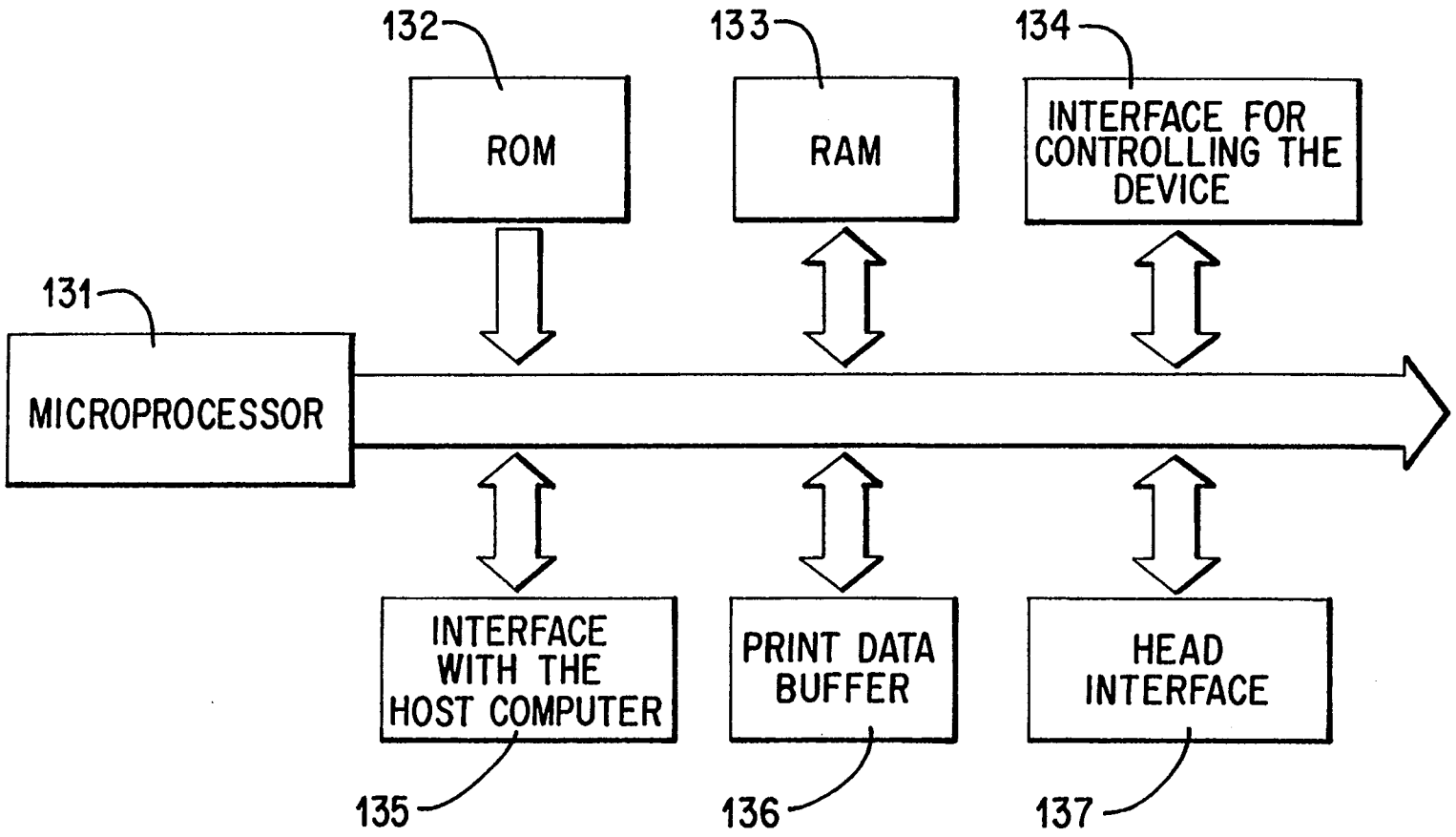
FIG. 16 is a block diagram showing the control circuit.
Figure 17A:
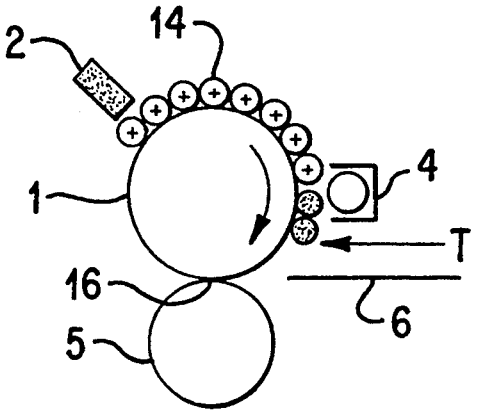
FIGS. 17 (*a*) to (*d*) show the behavior of the image recording device.
Figure 17B:
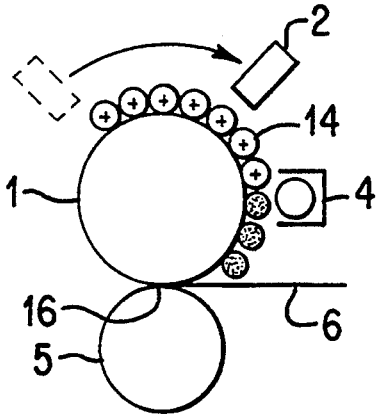
Figure 17C:
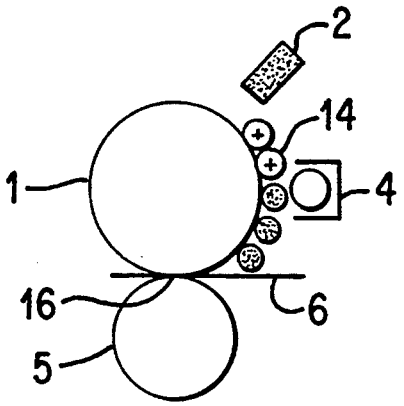
Figure 17D:
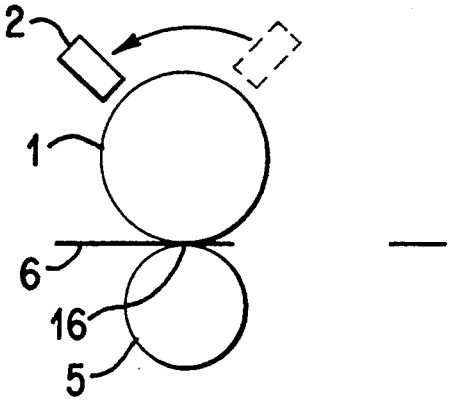

FIG. 16 is a block diagram showing the control circuit of this embodiment of the image recording device.

In the figure, 131 is a microprocessor, which functions to control the whole image recording device. The control circuit comprises the microprocessor 131, a ROM 132 to store the program of the microprocessor 131, a RAM 133 which is a temporary data storing portion, an interface 134 to control the device, an interface 135 with the host computer, a print data buffer 136 to store the print data transmitted from the host computer temporarily and an interface 137 with the recording head 2.

In the present embodiment, image recording is controlled by the microprocessor 131. The microprocessor 131 first starts recording an electrostatic latent image on the dielectric drum 1 by means of the recording head 2, and stops the recording by the recording head 2 awhile and moves the recording head 2 downstream in the direction around the circumference of the dielectric drum 1 by the moving means by a specified amount immediately before the transfer medium 6 completes the process of entering the contact portion for transferring and fixing 16 between the dielectric drum 1 and the pressure roller 5. After the transfer medium 6 passes through the contact portion for transferring and fixing 16 between the dielectric drum 1 and the pressure roller 5, the electrostatic latent image recording is restarted by the recording head 2 moved downstream in the direction around the circumference of the dielectric drum 1, being controlled so that the image to be recorded joins onto the partly recorded image.

With the above described structure, in the image recording device according to the present embodiment, image defects occurring when the transfer medium enters the contact portion for transferring and fixing are prevented as follows. Here, prior to the image recording, the recording head 2 is moved to the predetermined position upstream in the direction around the circumference of the dielectric drum 1 in advance by the moving means 50, as shown in FIG. 14.

As shown in FIG. 16, if the image recording device receives the print-request signal from the host computer through the interface 135 with the host computer, the microprocessor 131 starts the drive means of the dielectric drum 1, which is not shown in the figure, through the interface 134 to control the device and rotates the dielectric drum 1 at a predetermined rotation speed. If the rotation speed of the dielectric drum 1 reaches the predetermined value, the microprocessor 131 transmits the signal indicating that the print data can be accepted to the host computer through the interface 135 with the host computer. Receiving the signal, the host computer transmits the print data to the image recording device. The microprocessor 131 receives the print data through the interface 135 with the host computer and transmits the print data to the recording head 2 from the interface 137 with the recording head. As print data is received, the microprocessor 131 starts the transfer medium feeding roller 9 through the interface 134 to control the device and starts feeding the transfer medium 6 as shown in FIG. 17 (*a*).

The microprocessor 131 starts to count time from when the feeding of the transfer medium 6 is started, and it stops the transmission of print data to the recording head 2 at the timing when the transfer medium 6 approaches near the contact portion for transferring and fixing 16 as shown in FIG. 17 (*b*). Meanwhile, the microprocessor 131 transmits a signal requesting a temporary halt to the print data transmission is transmitted to the host computer through the interface 135 with the host computer. Here, as there is inevitably a time lag between the timing when a signal requesting a temporary halt to the print data transmission is output from the image recording device to the host computer and when the host computer actually stops the print data transmission to the image recording device, the print data transmitted from the host computer by the lag is temporarily stored in the print data buffer 136.

On the other hand, the microprocessor 131 starts a drive motor 231 through the interface 134 to control the device and rotates the male screw 232 connected to the drive axis of the drive motor 131, by which the female screw 233 fixed to the male screw 232 is moved toward the motor 231 as shown in FIG. 15. In accordance with this behavior, the recording head 2 moves in the downstream direction around the circumference of the dielectric drum 1 guided by the control member 234 as shown in FIG. 17 (*b*). The distance between the original position and the new position of the recording head is specified to be 25.4 mm on the dielectric drum 1 and the time necessary for the recording head 2 to move over the distance is 0.5 seconds. On the other hand, the rotation speed of the dielectric drum 1, that is, the process speed is 25.4 mm/second and the time necessary for the dielectric drum 1 to move over the above described distance is 1 second. Thus, the distance over which the recording head 2 moves is at least the value obtained by multiplying the time from when the leading (or trailing) edge of the transfer medium 6 enters (or leaves) the contact portion for transferring and fixing 16 until the rotation of the dielectric drum 1 is stabilized plus a margin for example, 0.8 seconds, by the process speed of 25.4 mm/second.

After that, the transfer medium 6 entering the contact portion for transferring and fixing 16 between the dielectric drum 1 and the pressure roller 5, the microprocessor 131 counts time until the rotation of the dielectric drum 1 is stabilized and then it starts transmitting the print data stored in the print data buffer 136 to the recording head 2 moved to the predetermined position through the interface 137 with the recording head. In addition to this, the microprocessor 131 transmits the print data transmission starting signal to the host computer through the interface 135 with the host computer. Receiving the print data transmission starting signal, the host computer restarts the print data transmission, and the microprocessor 131 continues printing by transmitting the print data to the recording head 2 again. Thus, image printing on the first sheet of transfer medium 6 is carried out as shown in FIG. 17 (*c*).

After printing, the microprocessor 131 restarts the recording head moving means 50 and returns the recording head 2 to the predetermined position upstream in the direction around the circumference of the dielectric drum 1 as shown in FIG. 17 (*d*).

In the present embodiment, the recording head is not restricted to an ion flow controlling recording head, and if a photoreceptive drum, for example, the one using α-silicon as the photoreceptor is used instead of the dielectric drum, an LED image bar, a fluorescent emitting device, a crystal shutter exposing device or other means is used for light writing means.

In the present embodiment, the angular position of the dielectric drum is detected by the time count performed by the microprocessor 131, and timing control may also be carried out by fixing a rotary encoder to the rotation axis of the dielectric drum 1 and counting the pulse.

The structure and function of other portions of the present embodiment are the same as those of the first embodiment, so the description thereof are omitted.

EMBODIMENT 5

Figure 18:
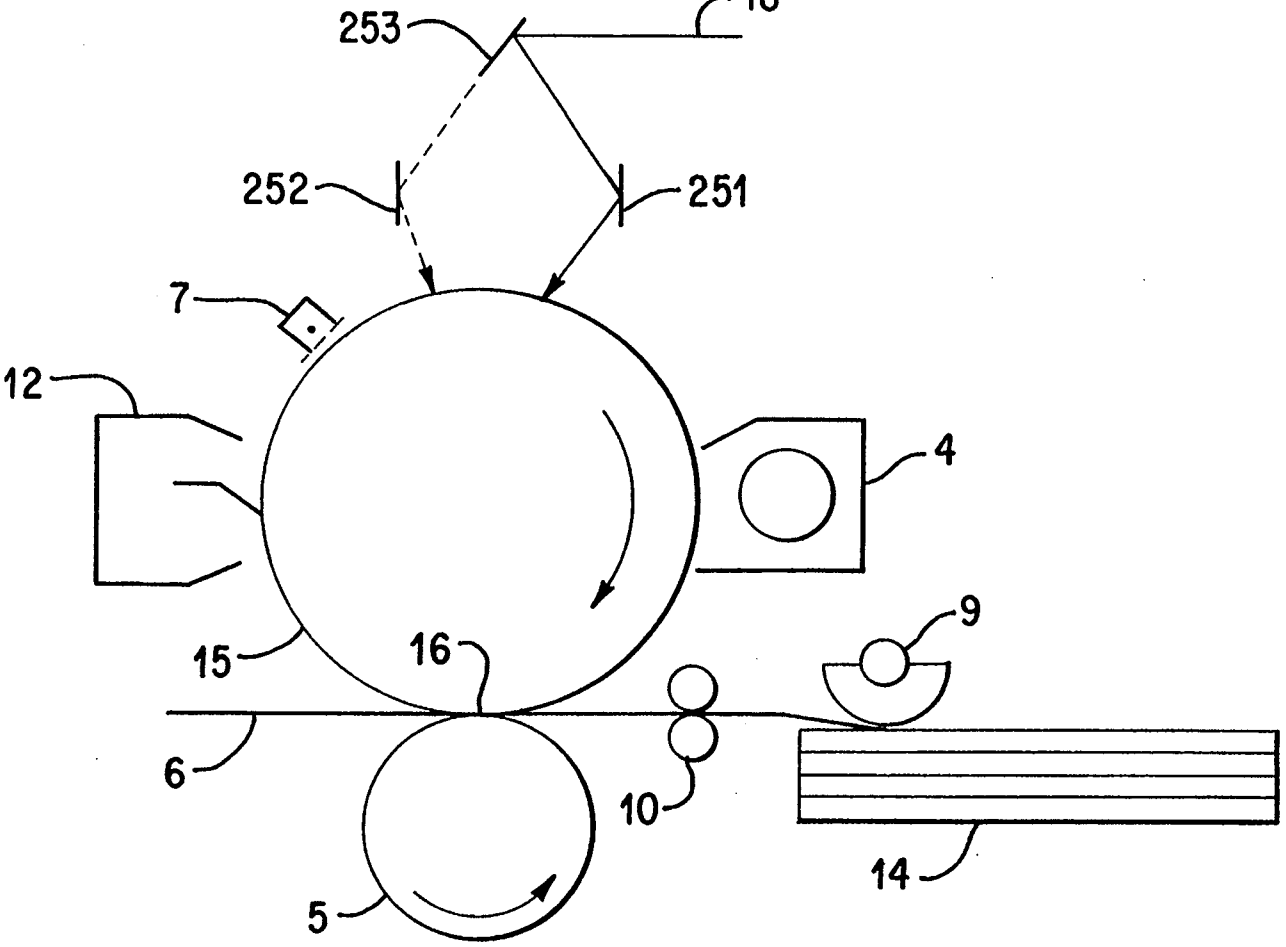
FIG. 18 shows a fifth embodiment of the image recording device according to the present invention.

FIGS. 18 and 22 show a fifth embodiment of the present invention, and portions which are the same as in the above described embodiments are identified by the same reference numerals. In the present embodiment, a photoreceptive drum is used as the image holding member, and optical exposing means which carries out optical exposure in accordance with image information on the image holding member preparatorily and uniformly charged is employed as electrostatic latent image forming means.

In the present embodiment, a photoreceptive drum 15 using an α-silicon as a photoreceptor is employed as the image holding member. The photoreceptive drum 15 is rotated by the drive means which is not shown in the figure in the direction shown by an arrow at a surface speed of 25.4 mm/second, and 18 is a laser beam which scans and exposes the surface of the photoreceptive drum 15 in accordance with the image information by a known art. In the present invention, the laser beam emitted from the semiconductor laser is scanned by a polygon mirror, which is not shown in the figure, in the direction along the axis of the photoreceptive drum 15.

Figure 19:
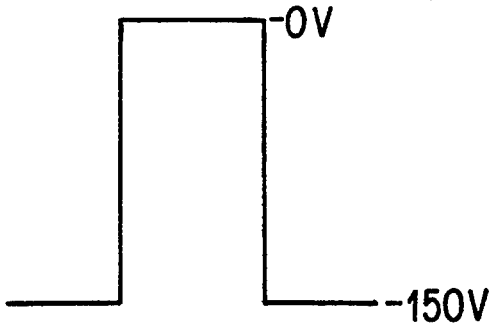
FIG. 19 shows the potentials of the electrostatic latent image.

The laser beam, as shown in FIG. 18, carries out optical exposure at the two positions on the photoreceptive drum 15 by an variable-angle mirror 253 and fixed mirrors 251 and 252. As a result, an electrostatic latent image as shown in FIG. 19 can be recorded on the surface of the photoreceptive drum 15 with an image density of 300 dpi. Further, a developing device to develop the electrostatic latent image formed on the photoreceptive drum is disposed downstream of the second exposure position and adjacent to the surface of the photoreceptive drum. For the developing device, any appropriately selected known prior art can be used. In the present embodiment, the one using a conductive magnetic single-component developing system is used for the developing device 4, and the portion having a voltage of 0 V with respect to the developing bias of −150 V is developed. The structure of the pressure roller 5 and the way in which the pressure roller 5 contacts the photoreceptive drum 15 is the same as the first embodiment.

Figure 20:
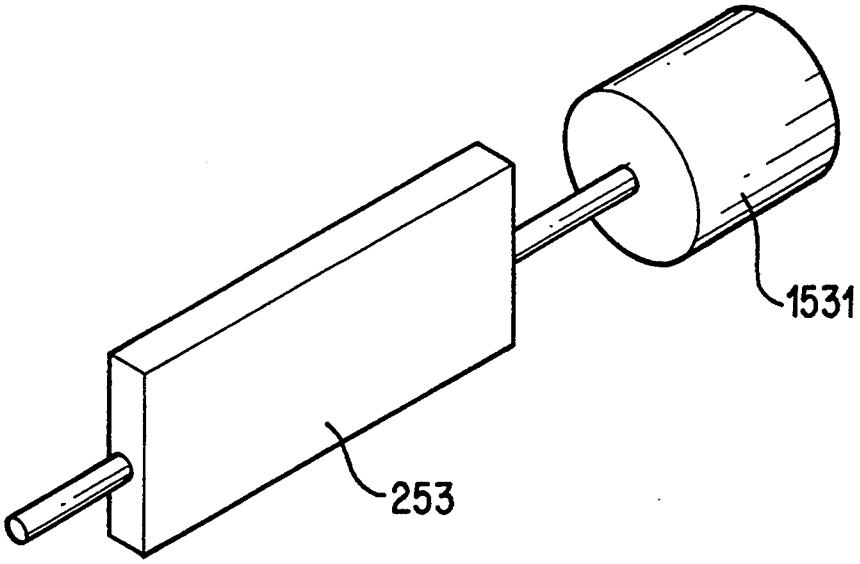
FIG. 20 is a schematic view showing the drive system of the variable-angle mirror.

FIG. 20 shows a structure of the variable-angle mirror, and the rotation axis of the stepping motor 1531 is connected to one side of the rotation axis of the variable-angle mirror 253 supported movably by the support member which is not shown in the figure, and the angle of the variable-angle mirror 253 is variable in accordance with the angular position of the stepping motor 1531. By varying the angle of the mirror, the reflection angle of the laser beam 18 is varied, by which the laser beam 18 impinges on the fixed mirrors 251 or 252.

Figure 21:
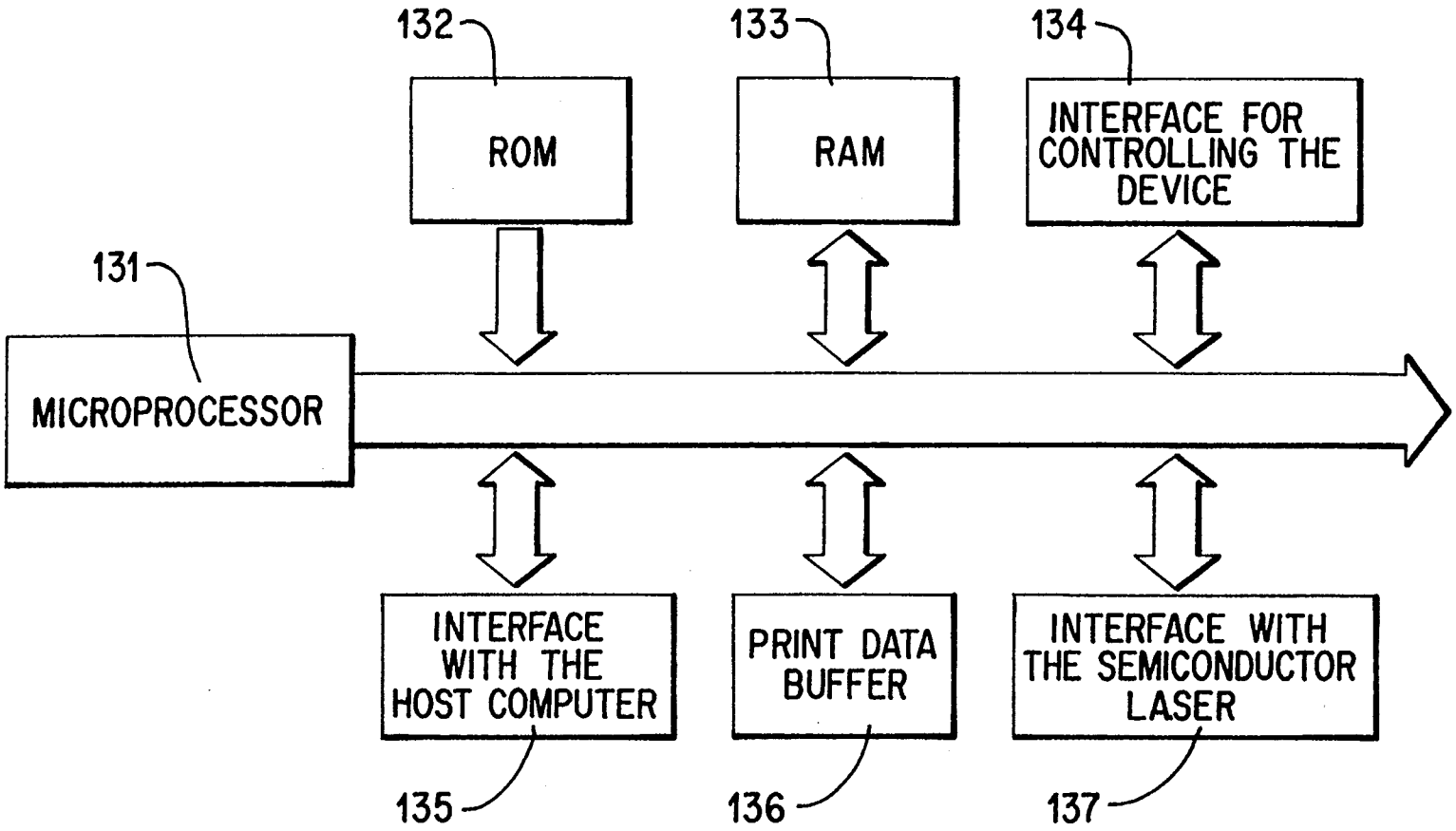
FIG. 21 is a block diagram showing the control circuit of the embodiment shown in FIG. 18.
Figure 22A:
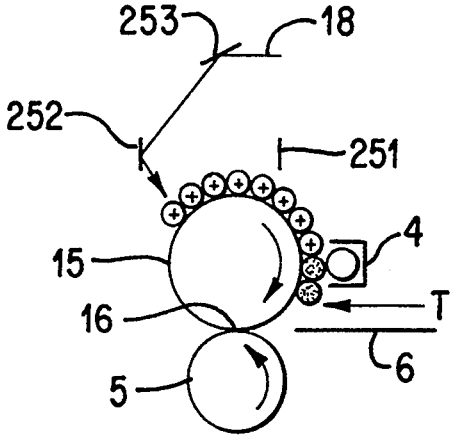
FIGS. 22 (*a*) to (*d*) show the behavior of the image recording device.
Figure 22B:
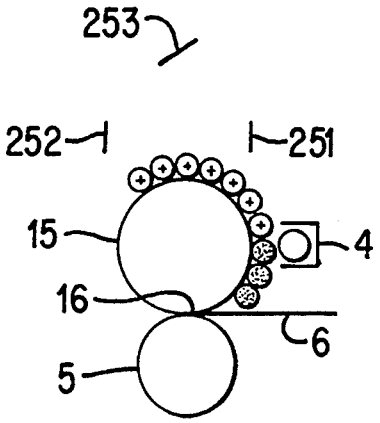
Figure 22C:
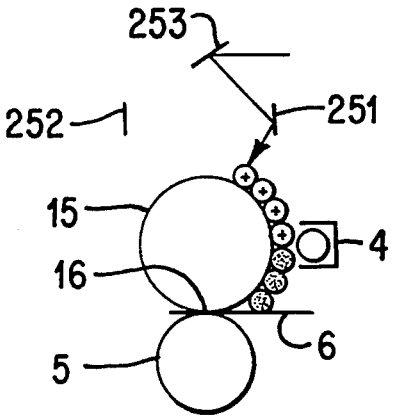
Figure 22D:
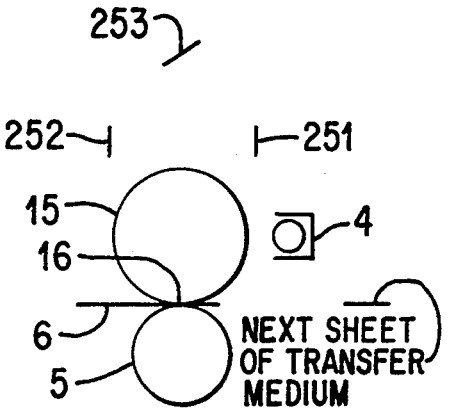

FIG. 21 shows a control circuit of the image recording device.

In the figure, 131 functions to control the whole image recording device. The control circuit comprises the microprocessor 131, a ROM 132 to store the program of the microprocessor 131, a RAM 133 which is a temporary data storing portion, an interface 134 for controlling the device, an interface 135 with the host computer, a print data buffer 136 to store the print data transmitted from the host computer temporarily and an interface 137 with the semiconductor laser.

In the present embodiment, image recording is controlled by the microprocessor 131, and the microprocessor 131 first controls the variable-angle mirror 253, starts optical exposure at the first exposure position of the photoreceptive drum 15 in accordance with the image information on the photoreceptive drum 15 by means of the first fixed mirror 252, and immediately before the transfer medium 6 completes the process of entering the contact portion 16 between the photoreceptive drum 15 and the pressure roller 5, it stops the optical exposure by the first fixed mirror 252. After the transfer medium 6 passes through the contact portion 16, the microprocessor 131 controls the variable-angle mirror 253 and restarts optical exposure on the photoreceptive drum 15 at the second exposure position of the photoreceptive drum 15 by means of the second fixed mirror 251, such that the image to be recorded joins onto the partly recorded portion.

With the above described structure, in the image recording device according to the present embodiment, image defects occurring when the transfer medium enters the contact portion for transferring and fixing is prevented as follows. As shown in FIG. 21, receiving the print-request signal from the host computer through the interface 135 with the host computer, the microprocessor 131 starts the drive means of the photoreceptive drum 15 which is not shown in the figure through the interface 134 for controlling the device and rotates the photoreceptive drum 15 at a predetermined rotation speed. When the rotation speed of the photoreceptive drum 15 reaches the determined value, the microprocessor 131 transmits the signal indicating that the print data can be accepted to the host computer through the interface 135 with the host computer. The host computer, receiving the signal, transmits the print data to the image recording device. The microprocessor 131 receives the print data through the interface 135 with the host computer, sends the print data from the interface 137 with the semiconductor laser to the semiconductor laser and starts optical exposure as shown in FIG. 22 (*a*). As print data is received, the microprocessor 131 starts the transfer medium feeding roller 9 through the interface 134 for controlling the device, by which the feeding of the transfer medium 6 is started.

The microprocessor 131 counts time from when the feeding of the transfer medium 6 is started, and it stops the print data transmission to the semiconductor laser at the timing when the transfer medium 6 approaches near the contact portion for transferring and fixing 16 as shown in FIG. 22 (*a*). Meanwhile, the microprocessor 131 transmits a signal requesting a temporary halt to the print data transmission to the host computer through the interface 135 with the host computer. Here, as there is inevitably a time lag between the time when the signal requesting a temporary halt to the print data transmission is output from the image recording device to the host computer and when the host computer actually stops the print data transmission to the image recording device, the print data transmitted from the host computer by the lag is temporarily stored in the print data buffer 136. On the other hand, the microprocessor 131 starts the motor 1531 through the interface 134 for controlling the device, varies the angle of the variable-angle mirror 253 and makes the laser beam 18 impinge on the fixed mirror 251 as shown in FIG. 22 (*c*). Here, as the laser beam 18 must be focused (imaged) at different positions on the surface of the photoreceptive drum 15 because of the angle variation of the variable-angle mirror 253, the optical path length between the variable-angle mirror 253 and the fixed mirror 251 and that between the variable-angle mirror 253 and the fixed mirror 252 must be the same.

The distance between the two image formation positions (image focus position)on the photoreceptive drum 15, which is caused by the angle variation of the variable-angle mirror 253, is 25.4 mm, and the time necessary for the angle variation is 0.1 seconds. On the other hand, the rotation speed of the photoreceptive drum 15, that is, the process speed is 25.4 mm/second, and the time necessary for the movement over the distance is 1 second, which is counted from the time when the leading (or trailing) edge of the transfer medium 6 enters (or leaves) the contact portion 16 until the rotation of the photoreceptive drum 15 is stabilized plus a time margin.

After that, the transfer medium 6 entering the contact portion for transferring and fixing 16 between the photoreceptive drum 15 and the pressure roller 5, the microprocessor 131 counts time until the rotation of the photoreceptive drum 15 is stabilized and then starts transmitting the print data stored in the print data buffer 136 to the semiconductor laser through the interface 137 with the semiconductor laser. In addition to this, the microprocessor 131 transmits the print data transmission starting signal to the host computer through the interface 135 with the host computer. Receiving the print data transmission starting signal, the host computer restarts print data transmission, and the microprocessor 131 continues printing by transmitting the transmitted print data to the semiconductor laser again. Thus, image printing on the first sheet of transfer medium 6 is carried out. After the printing, the microprocessor 131 varies the angle of the variable-angle mirror 253, returns the exposure position of the laser beam 18 with respect to the photoreceptive drum upstream in the direction around the circumference of the photoreceptive drum and prepares for the next printing as shown in FIG. 22 (*d*).

As the structure and function of other portions of the present embodiment are the same as those of the first embodiment, the description thereof is omitted.

What is claimed is:

1. An image recording device forming an electrostatic latent image on a surface of an image holding member in accordance with image information and transferring by pressure an image made by developing the electrostatic latent image to a transfer medium which passes through a contact portion between said image holding member and a pressure roller bearing against said image holding member, said image holding member rotating in a developing direction, said image recording device comprising:

a plurality of electrostatic latent image forming means disposed adjacent to and around the circumference of said image holding member at predetermined spacings and forming an electrostatic latent image on said image holding member, at least one of said plurality of electrostatic latent image forming means being located upstream in said developing direction of a remainder of said plurality of electrostatic latent image forming means; and controlling means for starting electrostatic latent image formation by said at least one upstream electrostatic latent image forming means, stopping electrostatic latent image formation by said at least one upstream electrostatic latent image forming means immediately before the transfer medium enters said contact portion between said image holding member and said pressure roller, and continuing electrostatic latent image formation by said remainder of said electrostatic latent image forming means, after the transfer medium enters said contact portion between said image holding member and said pressure roller.

2. The image recording device described in claim 1, wherein said at least one upstream electrostatic latent image forming means forms an electrostatic latent image by controlling an ion flow and functions as charging means for charging the surface of said image holding member uniformly.

3. The image recording device described in claim 1, further comprising angular position detecting means for detecting an angular position of said image holding member.

4. The image recording device described in claim 1, wherein said at least one upstream electrostatic latent image forming means forms an electrostatic latent image by controlling a flow of ions, and wherein said image recording device further comprises switching means for moving said at least one upstream electrostatic latent image forming means in said developing direction around the circumference of said image holding member.

5. The image recording device described in claim 1, wherein electrostatic latent image formation is stopped from immediately before the transfer medium completes a process of entering said contact portion for transferring and fixing until the transfer medium enters said contact portion for transferring and fixing, and a period for which said electrostatic latent image formation is stopped is determined by a time from when the leading edge of the transfer medium enters said contact portion for transferring and fixing until the rotation of said image holding member is stabilized plus a time margin.

6. The image recording device described in claim 1, further comprising first and second electrostatic latent image forming positions wherein, in forming an electrostatic latent image on said image holding member, said at least one of said plurality of electrostatic latent image forming means is disposed at said first electrostatic latent image forming position and forms the electrostatic latent image on said image holding member in accordance with image information when a portion corresponding to a leading edge of the transfer medium on said image holding member reaches said first electrostatic latent image forming position and until immediately before the transfer medium completes entering said contact portion; and after the transfer medium has passed into said contact portion, said remainder of said plurality of electrostatic latent image forming means are disposed at said second electrostatic latent image forming position and forms the electrostatic latent image on said image holding member in accordance with image information when a trailing edge of said electrostatic latent image formed by said at least one of said plurality of electrostatic latent image forming means reaches said second electrostatic latent image forming position of said remainder of electrostatic latent image forming means, and until a portion corresponding to the trailing edge of the transfer medium reaches said second electrostatic latent image forming position of said remainder of said plurality of electrostatic latent image forming means; and said at least one of said plurality of electrostatic latent image forming means disposed at said first electrostatic latent image forming position and said remainder of said plurality of electrostatic latent image forming means disposed at said second electrostatic latent image forming position are independently disposed.

7. The image recording device described in claim 1, further comprising first and second electrostatic latent image forming positions, wherein said at least one upstream electrostatic latent image forming means comprises a single electrostatic latent image forming means, and in forming an electrostatic latent image on said image holding member, said single electrostatic latent image forming means is disposed at said first electrostatic latent image forming position and forms the electrostatic latent image on said image holding member in accordance with image information when a portion corresponding to a leading edge of the transfer medium on said image holding member reaches said first electrostatic latent image forming position and until immediately before the transfer medium completes entering said contact portion; and after the transfer medium has passed into said contact portion, said single electrostatic latent image forming means is then disposed at said second electrostatic latent image forming position and forms an electrostatic latent image on said image holding member in accordance with image information when a trailing edge of the electrostatic latent image formed at said first electrostatic latent image forming position reaches said second electrostatic latent image forming position and until a portion corresponding to the trailing edge of the transfer medium reaches said second electrostatic latent image forming position; and said single electrostatic latent image forming means is movable between said first and second electrostatic latent image forming positions.

8. An image recording device which forms an electrostatic latent image on a surface of an image holding member in accordance with image information and transfers by pressure an image made by developing the electrostatic latent image to a transfer medium which passes through a contact portion between said image holding member and a pressure roller bearing against said image holding member, said image holding member rotating in a developing direction, said image recording device comprising:

movable electrostatic latent image forming means, disposed adjacent to and around the circumference of said image holding member and forming an electrostatic latent image on said image holding member;

switching means for switching where the electrostatic latent image is formed by said electrostatic latent image forming means, so that said electrostatic latent image forming means can form the electrostatic latent image in a plurality of positions around the circumference of said image holding member; and controlling means for starting electrostatic latent image formation by said electrostatic latent image forming means disposed around the circumference of said image holding member, stopping electrostatic latent image formation by said electrostatic latent image forming means disposed around the circumference of said image holding member and switching by said switching means said electrostatic latent image forming means to a predetermined position around the circumference of said image holding member immediately before the transfer medium completes entering said contact portion between said image holding member and said pressure roller, and continuing electrostatic latent image formation by said electrostatic latent image forming means after the transfer medium enters said contact portion between said image holding member and said pressure roller.

9. The image recording device described in claim 8, wherein said movable electrostatic latent image forming means forms an electrostatic latent image by controlling a flow of ions and said switching means moves said movable electrostatic latent image forming means in said developing direction around the circumference of said image holding member.

10. The image recording device described in claim 8, wherein said movable electrostatic latent image forming means forms an electrostatic latent image by optical exposure and said switching means switches an optical exposure position of said electrostatic latent image forming means.

* * * * *